US009607622B2

(12) United States Patent
Okimoto et al.

(10) Patent No.: US 9,607,622 B2
(45) Date of Patent: Mar. 28, 2017

(54) AUDIO-SIGNAL PROCESSING DEVICE, AUDIO-SIGNAL PROCESSING METHOD, PROGRAM, AND RECORDING MEDIUM

(75) Inventors: Koyuru Okimoto, Tokyo (JP); Yuuji Yamada, Tokyo (JP); Juri Sakai, Tokyo (JP)

(73) Assignee: Sony Corporation, Tokyo (JP)

( * ) Notice: Subject to any disclaimer, the term of this patent is extended or adjusted under 35 U.S.C. 154(b) by 323 days.

(21) Appl. No.: 13/591,814

(22) Filed: Aug. 22, 2012

(65) Prior Publication Data

US 2013/0089209 A1 Apr. 11, 2013

(30) Foreign Application Priority Data

Oct. 7, 2011 (JP) ..... 2011-223485

(51) Int. Cl.
*H04S 3/00* (2006.01)
*G10L 19/008* (2013.01)

(52) U.S. Cl.
CPC ..... *G10L 19/008* (2013.01); *H04S 3/004* (2013.01); *H04S 3/008* (2013.01); *H04S 2400/01* (2013.01); *H04S 2400/03* (2013.01)

(58) Field of Classification Search
CPC ..... H04S 2420/01; H04S 1/005; H04S 3/004; H04S 2400/00; H04S 2400/01; H04S 2400/03; H04S 3/008; G10L 19/008
USPC ..... 381/310, 98, 119, 309, 74, 17–23
See application file for complete search history.

(56) References Cited

U.S. PATENT DOCUMENTS

| | | | | |
|---|---|---|---|---|
| 5,404,406 | A * | 4/1995 | Fuchigami et al. | 381/17 |
| 6,928,179 | B1 * | 8/2005 | Yamada et al. | 381/309 |
| 6,961,632 | B2 * | 11/2005 | Hashimoto et al. | 700/94 |
| 7,466,831 | B2 * | 12/2008 | Magrath | H04S 1/002 381/1 |
| 7,720,240 | B2 * | 5/2010 | Wang | 381/309 |
| 8,243,969 | B2 * | 8/2012 | Breebaart et al. | 381/309 |
| 8,285,556 | B2 * | 10/2012 | Jung et al. | 704/500 |
| 8,873,761 | B2 * | 10/2014 | Fukui et al. | 381/17 |
| 2007/0154019 | A1 * | 7/2007 | Kim | 381/17 |
| 2009/0046864 | A1 * | 2/2009 | Mahabub et al. | 381/17 |

(Continued)

FOREIGN PATENT DOCUMENTS

JP 2006-014218 1/2006

*Primary Examiner* — Xu Mei
*Assistant Examiner* — Jason R Kurr
(74) *Attorney, Agent, or Firm* — Paratus Law Group, PLLC

(57) ABSTRACT

An audio-signal processing device includes a decoding unit that decodes a compressed audio stream to obtain audio signals for a predetermined number of channels; a signal processing unit that generates 2-channel audio signals including left-channel audio signals and right-channel audio signals, on the basis of the predetermined-number-of-channels audio signals; and a coefficient setting unit that sets filter coefficients corresponding to the impulse responses for the digital filters, on the basis of format information of the compressed audio stream. The signal processing unit uses digital filters to convolve impulse responses for paths from sound-source positions of the channels to the left and right ears of a listener with the corresponding predetermined-number-of-channels audio signals and adds corresponding results of the convolutions for the channels to generate the left-channel audio signals and the right-channel audio signals.

28 Claims, 18 Drawing Sheets

(56) References Cited

U.S. PATENT DOCUMENTS

2012/0213375 A1* 8/2012 Mahabub et al. ..... 381/17

* cited by examiner

AUDIO-SIGNAL PROCESSING DEVICE, AUDIO-SIGNAL PROCESSING METHOD, PROGRAM, AND RECORDING MEDIUM

BACKGROUND

The present technology relates to an audio-signal processing device, an audio-signal processing method, a program, and a recording medium. In particular, the present technology relates to an audio-signal processing device, an audio-signal processing method, a program, and a recording medium that can be applied to a headphone device, a speaker device, and so on that reproduce 2-channel stereo audio signals.

When audio signals are supplied to speakers and are reproduced, the sound image is localized in front of a listener. In contrast, when the same audio signals are supplied to a headphone device and are reproduced, the sound image is localized within the head of the listener to thereby create a significantly unnatural sound field. In order to correct the unnatural sound field in the sound-field localization by the headphone device, for example, Japanese Unexamined Patent Application Publication No. 2006-14218 discloses a headphone device adapted to achieve natural out-of-head sound-image localization as if audio signals were reproduced from actual speakers. In the headphone device, impulse responses from an arbitrary speaker position to both ears of a listener are measured or calculated and digital filters or the like are used to convolve the impulse responses with audio signals and the resulting audio signals are reproduced.

Now, a description will be given of an impulse response for sound-image localization for a headphone device. As illustrated in FIG. 28, it is assumed that a sound source SP whose sound image is to he localized is located directly in front of a listener M. Sound output from the sound source SP reaches the left and right ears of the listener M along paths having transfer functions HL and HR. Transform of such transfer functions HL and HR into representations along a time axis provides impulse responses for the left channel and the right channel.

SUMMARY

In multi-channel reproduction, estimated channel layout may vary depending on the format of a compressed audio stream. For example, 7.1-channel audio signals may contain 2-channel audio signals for left and right front high channels or may contain 2-channel audio signals for left and right back surround channels in addition to general 5.1 channels.

It is desirable to perform sound-image localization processing in a favorable manner and to reduce the amount of memory.

According to an embodiment of the present technology, there is provided an audio-signal processing device. The audio processing device includes: a decoding unit configured to decode a compressed audio stream to obtain audio signals for a predetermined number of channels; a signal processing unit configured to generate 2-channel audio signals including left-channel audio signals and right-channel audio signals, on the basis of the predetermined-number-of-channels audio signals obtained by the decoding unit, wherein the signal processing unit uses digital filters to convolve impulse responses for paths from sound-source positions of the channels to a left ear of a listener with the corresponding predetermined-number-of-channels audio signals and adds results of the convolutions for the channels to generate the left-channel audio signals and uses digital filters to convolve impulse responses for paths from the sound-source positions of the channels to a right ear of the listener with the corresponding predetermined-number-of-channels audio signals and adds results of the convolutions for the channels to generate the right-channel audio signals; and a coefficient setting unit configured to set filter coefficients corresponding to the impulse responses for the digital filters in the signal processing unit, on the basis of format information of the compressed audio stream.

In the present technology, the decoding unit decodes the compressed audio stream to obtain audio signals for the predetermined number of channels. Examples of the audio signals include 2-channel audio signals, 5.1-channel audio signals, and 7.1-channel audio signals. On the basis of the predetermined-number-of-channels audio signals, the signal processing unit generates 2-channel audio signals including the left-channel audio signals and the right-channel audio signals.

In this case, in the signal processing unit, digital filters are used to convolve impulse responses for paths from sound-source positions of the channels to a left ear of a listener with the corresponding predetermined-number-of-channels audio signals and results of the convolutions for the channels are added to generate the left-channel audio signals. Similarly, in the signal processing unit, digital filters are used to convolve impulse responses for paths from the sound-source positions of the channels to a right ear of the listener with the corresponding predetermined-number-of-channels audio signals and results of the convolutions for the channels are added to generate the right-channel audio signals.

A coefficient setting unit sets filter coefficients corresponding to the impulse responses for the digital filters in the signal processing unit, on the basis of format information of the compressed audio stream. For example, filter coefficients corresponding to an estimated channel layout determined by the format information are set for the digital filters for the channels indicated by decode-mode information of the decoding unit.

For example, when the format information indicates 5.1-channel audio signals, filter coefficients corresponding to the estimated channel layout are set for the digital filters for 6-channel audio signals. Also, for example, when the format information indicates 7.1-channel audio signals (including front high or back surround channel audio signals), filter coefficients corresponding to the estimated channel layout are set for the digital filters for 8-channel audio signals.

Thus, in the present technology, on the basis of the format information of the compressed audio stream, filter coefficients corresponding to the impulse responses are set for the digital filters in the signal processing unit. Thus, even when the format of the compressed audio stream Ast is changed, 2-channel stereo audio signals with which sound-image localization for each channel can be performed in a favorable manner can be obtained from audio signals for a predetermined number of channels.

In the present technology, at least one of the digital filters in the signal processing unit may be used to process the audio signals for multiple ones of the predetermined number of channels. The at least one digital filter used to process the audio signals for the multiple channels may process front high audio signals included in 7.1-channel audio signals or back surround audio signals included in 7.1-channel audio signals. Since the at least one of the digital filters is used to process the audio signals for multiple ones of the predetermined number of channels, the circuit scale of the signal processing unit can be reduced.

According to another embodiment of the present technology, there is provided an audio-signal processing device. The audio-signal processing device includes: a decoding unit configured to decode a compressed audio stream to obtain audio signals for a predetermined number of channels; and a signal processing unit configured to generate 2-channel audio signals including left audio signals and right audio signals, on the basis of the predetermined-number-of-channels audio signals obtained by the decoding unit. The signal processing unit uses digital filters to convolve impulse responses for paths from sound-source positions of the channels to a left ear of a listener with the corresponding predetermined-number-of-channels audio signals and adds results of the convolutions for the channels to generate the left audio signals and uses digital filters to convolve impulse responses for paths from the sound-source positions of the channels to a right ear of the listener with the corresponding predetermined-number-of-channels audio signals and adds results of the convolutions for the channels to generate the right audio signals. In the signal processing unit, the digital filters for processing at least the audio signals for a low-frequency enhancement channel are implemented by infinite impulse response filters.

In the present technology, the decoding unit decodes the compressed audio stream to obtain audio signals for the predetermined number of channels. Examples of the audio signals include 2-channel audio signals, 5.1-channel audio signals, and 7.1-channel audio signals. On the basis of the predetermined-number-of-channels audio signals, the signal processing unit generates 2-channel audio signals including the left audio signals and the right audio signals.

In this case, in the signal processing unit, digital filters are used to convolve impulse responses for paths from sound-source positions of the channels to a left ear of a listener with the corresponding predetermined-number-of-channels audio signals and results of the convolutions for the channels are added to generate the left audio signals. Similarly, in the signal processing unit, digital filters are used to convolve impulse responses for paths from the sound-source positions of the channels to a right ear of the listener with the corresponding predetermined-number-of-channels audio signals and results of the convolutions for the channels are added to generate the right audio signals.

In the signal processing unit, the digital filters for processing at least the audio signals (sub-woofer signals) for a low-frequency enhancement channel are implemented by IIR (infinite impulse response) filters. In this case, for example, the digital filters for processing the audio signals for the other channels may be implemented by FIR (finite impulse response) filters.

In the present technology, since the digital filters for processing at least the audio signals (sub-woofer signals) for the low-frequency enhancement channel are implemented by IIR filters, the amounts of memory and computation for processing the low-frequency enhancement channel audio signals can be reduced.

According to another embodiment of the present technology, there is provided an audio-signal processing device. The audio-signal processing device includes: a decoding unit configured to decode a compressed audio stream to obtain audio signals for a predetermined number of channels; and a signal processing unit configured to generate 2-channel audio signals including left audio signals and right audio signals, on the basis of the predetermined-number-of-channels audio signals obtained by the decoding unit. The signal processing unit uses digital filters to convolve impulse responses for paths from sound-source positions of the channels to a left ear of a listener with the corresponding predetermined-number-of-channels audio signals and adds results of the convolutions for the channels to generate the left audio signals, and uses digital filters to convolve impulse responses for paths from the sound-source positions of the channels to a right ear of the listener with the corresponding predetermined-number-of-channels audio signals and adds results of the convolutions for the channels to generate the right audio signals. In the signal processing unit, the filter coefficient set for the digital filter for processing audio signals for a front high channel is data obtained by combination of actual-sound-field data and anechoic-room data.

In the present technology, the decoding unit decodes the compressed audio stream to obtain audio signals for the predetermined number of channels. Examples of the audio signals include 2-channel audio signals, 5.1-channel audio signals, and 7.1-channel audio signals. On the basis of the predetermined-number-of-channels audio signals, the signal processing unit generates 2-channel audio signals including the left audio signals and the right audio signals.

In this case, in the signal processing unit, digital filters are used to convolve impulse responses for paths from sound-source positions of the channels to a left ear of a listener with the corresponding predetermined-number-of-channels audio signals and results of the convolutions for the channels are added to generate the left audio signals. Similarly, in the signal processing unit, digital filters are used to convolve impulse responses for paths from the sound-source positions of the channels to a right ear of the listener with the corresponding predetermined-number-of-channels audio signals and results of the convolutions for the channels are added to generate the right audio signals.

In this case, in the signal processing unit, the filter coefficient set for the digital filter for processing audio signals for a front high channel is data obtained by combination of actual-sound-field data and anechoic-room data. For example, the actual-sound-field data may include speaker characteristics of the front channel and reverberation-part data of the front channel.

In the present technology, in the signal processing unit, the filter coefficient set for the digital filter for processing audio signals for a front high channel is data obtained by combination of actual-sound-field data and anechoic-room data. Thus, for example, even for a typical 5.1 channel layout in an actual sound field, filter coefficients for front high channels of 7.1 channels can be easily obtained.

According to a still another embodiment of the present technology, there is provided an audio-signal processing device. The audio-signal processing device includes: a decoding unit configured to decode a compressed audio stream to obtain audio signals for a predetermined number of channels; a signal processing unit configured to generate 2-channel audio signals including left-channel audio signals and right-channel audio signals, on the basis of the predetermined-number-of-channels audio signals obtained by the decoding unit, wherein the signal processing unit uses digital filters to convolve impulse responses for paths from sound-source positions of the channels to a left ear of a listener with the corresponding predetermined-number-of-channels audio signals and adds results of the convolutions for the channels to generate the left-channel audio signals and uses digital filters to convolve impulse responses for paths from the sound-source positions of the channels to a right ear of the listener with the corresponding predetermined-number-of-channels audio signals and adds results of the convolutions for the channels to generate the right-channel audio signals, and the convolutions by the digital filters are performed in a frequency domain; a coefficient holding unit configured to hold time-series coefficient data as filter coefficients corresponding to the impulse responses; and a coefficient setting unit configured to read the time-series coefficient data held by the coefficient holding unit, transform the time-series coefficient data into frequency-domain data, and set the frequency-domain data for the digital filters.

In the present technology, the decoding unit decodes the compressed audio stream to obtain audio signals for the predetermined number of channels. Examples of the audio signals include 2-channel audio signals, 5.1-channel audio signals, and 7.1-channel audio signals. On the basis of the predetermined-number-of-channels audio signals, the signal processing unit generates 2-channel audio signals including the left-channel audio signals and the right-channel audio signals.

In this case, in the signal processing unit, digital filters are used to convolve impulse responses for paths from sound-source positions of the channels to a left ear of a listener with the corresponding predetermined-number-of-channels audio signals and results of the convolutions for the channels are added to generate the left audio signals. Similarly, in the signal processing unit, digital filters are used to convolve impulse responses for paths from the sound-source positions of the channels to a right ear of the listener with the corresponding predetermined-number-of-channels audio signals and results of the convolutions for the channels are added to generate the right audio signals.

In this case, the convolutions by the digital filters are performed in a frequency domain. Actual-time coefficient data are stored as the filter coefficients corresponding to the impulse responses. The coefficient setting unit reads the actual-time coefficient, data from the coefficient holding unit, transforms the actual-time coefficient data into frequency-domain data, and sets the frequency-domain data for the digital filters.

In the present technology, the time-series coefficient data are held, as the filter coefficients corresponding to the impulse pulses, the time-series coefficient data are transformed into frequency-domain data, and the frequency-domain data are set for the digital filters. Accordingly, it is possible to reduce the amount of memory that holds the filter coefficients.

According to the present technology, it is possible to perform sound-image localization processing in a favorable manner and it is also possible to reduce the amount of memory.

DETAILED DESCRIPTION OF EMBODIMENTS

A mode (herein referred to as an "embodiment") for implementing the present disclosure will be described below. A description below is given in the following sequence:

1. First Embodiment
2. Modification

<1. Embodiment>

[Example of Configuration of Audio Signal Processing Device]

Figure 1:
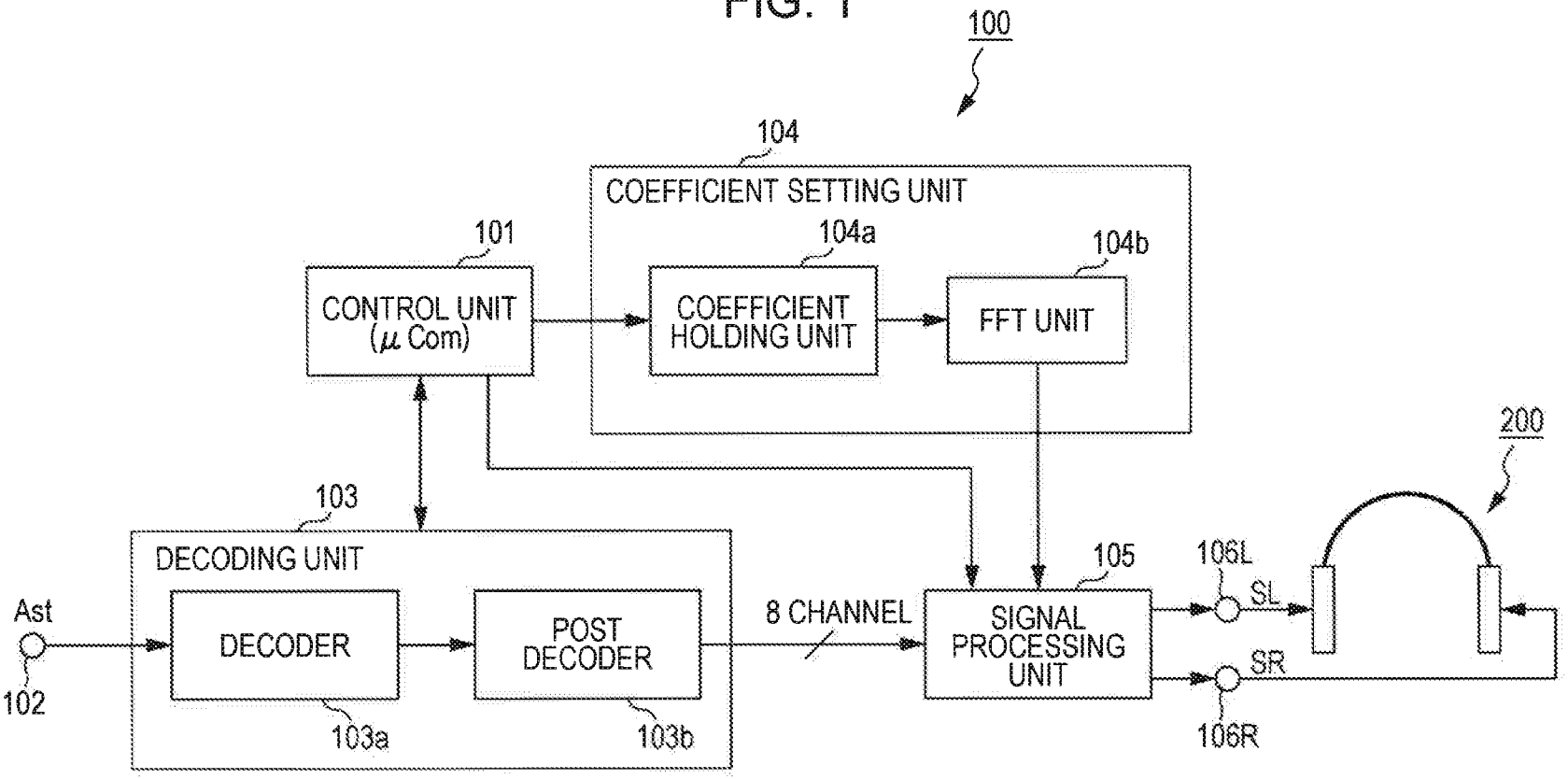
FIG. 1 is a block diagram illustrating the functional configuration of an audio-signal processing device according to one embodiment.

FIG. 1 illustrates an example of the configuration of an audio-signal processing device 100 according to an embodiment. The audio-signal processing device 100 has a control unit 101, an input terminal 102, a decoding unit 103, a coefficient setting unit 104, a signal processing unit 105, and output terminals 106L and 106R.

The control unit 101 includes a microcomputer to control operations of the individual elements in the audio-signal processing device 100. The input terminal 102 is a terminal for inputting a compressed audio stream Ast. The decoding unit 103 decodes the compressed audio stream Ast to obtain audio signals for a predetermined number of channels. Examples of the audio signals include 2-channel audio signals, 5.1-channel audio signals, and 7.1-channel audio signals.

As illustrated in FIG. 1, the decoding unit 103 includes, for example, a decoder 103*a* and a post decoder 103*b*. The decoder 103*a* performs decode processing on the compressed. audio stream Ast. In this case, in accordance with the format. of the compressed audio stream Ast, the decoder 103*a* obtains, for example, 2-channel audio signals, 5.1-channel audio signals, or 7.1-channel audio signals.

The decoder 103*a* in the decoding unit 103 performs the decode processing in a mode corresponding to the format of the compressed audio stream Ast. The decoding unit 103 sends this format information and decode-mode information to the control unit 101. Under the control of the control unit 101 based on the format information, for example, the post decoder 103*b* converts the 2-channel audio signals, obtained from the decoder 103*a*, to 5.1-channel or 7.1-channel audio signals or converts the 5.1-channel audio signals, obtained from the decoder 103*a*, to 7.1-channel audio signals.

The 2-channel audio signals contain audio signals for 2 channels including a left-front channel (FL) and a right-front channel (FR). The 5.1-channel audio signals contain audio signals for 6 channels including a left-front channel (FL), a right-front channel (FR), a center channel (C), a left-rear channel (SL), a right-rear channel (SR), and a low-frequency enhancement channel (LFE).

The 7.1-channel audio signals contain 2-channel audio signals in addition to 6-channel audio signals that are similar to the above-described 5.1-channel audio signals. In accordance with the format of the compressed audio stream Ast or as a result of the processing of the post decoder 103*b*, the 2-channel audio signals contained in the 7.1-channel audio signals are, for example, 2-channel audio signals for a left front high channel (HL) and a right front high channel (HF) or a left back surround channel (BL) and a right back surround (BR).

The signal processing unit 105 is implemented by, for example, a DSP (digital signal processor), and generates left-channel audio signals SL and right-channel audio signals SR to be supplied to a headphone device 200, on the basis of the predetermined-number-of-channels audio signals obtained by the decoding unit 103. Signal lines for the audio signals for the 8 channels of the 7.1 channels are prepared between an output side of the decoding unit 103 and an input side of the signal processing unit 105.

When 2-channel or 6-channel audio signals are output from the decoding unit 103, only signal lines for the corresponding channels are used to send the audio signals from the decoding unit 103 to the signal processing unit 105.

When the format of the compressed audio stream Ast is a 7.1-channel format and 8-channel audio signals are output from the decoding unit 103, all of the prepared signal lines are used to send the audio signals from the decoding unit 103 to the signal processing unit 105. In this case, the 2-channel audio signals for the left-front high channel (HL) and the right-front high channel (HR) and the 2-channel audio signals for the left-back surround channel (HL) and the right-back surround channel (BR) are sent through the same signal lines.

The signal processing unit 105 uses digital filters to convolve impulse responses for the paths from the sound-source positions of the channels to the left ear of a listener with the corresponding predetermined-number-of-channels audio signals and adds results of the convolutions for the channels to thereby generate the left-channel audio signals SL. Similarly, the signal processing unit 105 uses digital filters to convolve impulse responses for the paths from the sound-source positions of the channels to the right ear of the listener with the corresponding predetermined-number-of-channels audio signals and adds results of the convolutions for the channels to thereby generate the right-channel audio signals SR.

Figure 2:
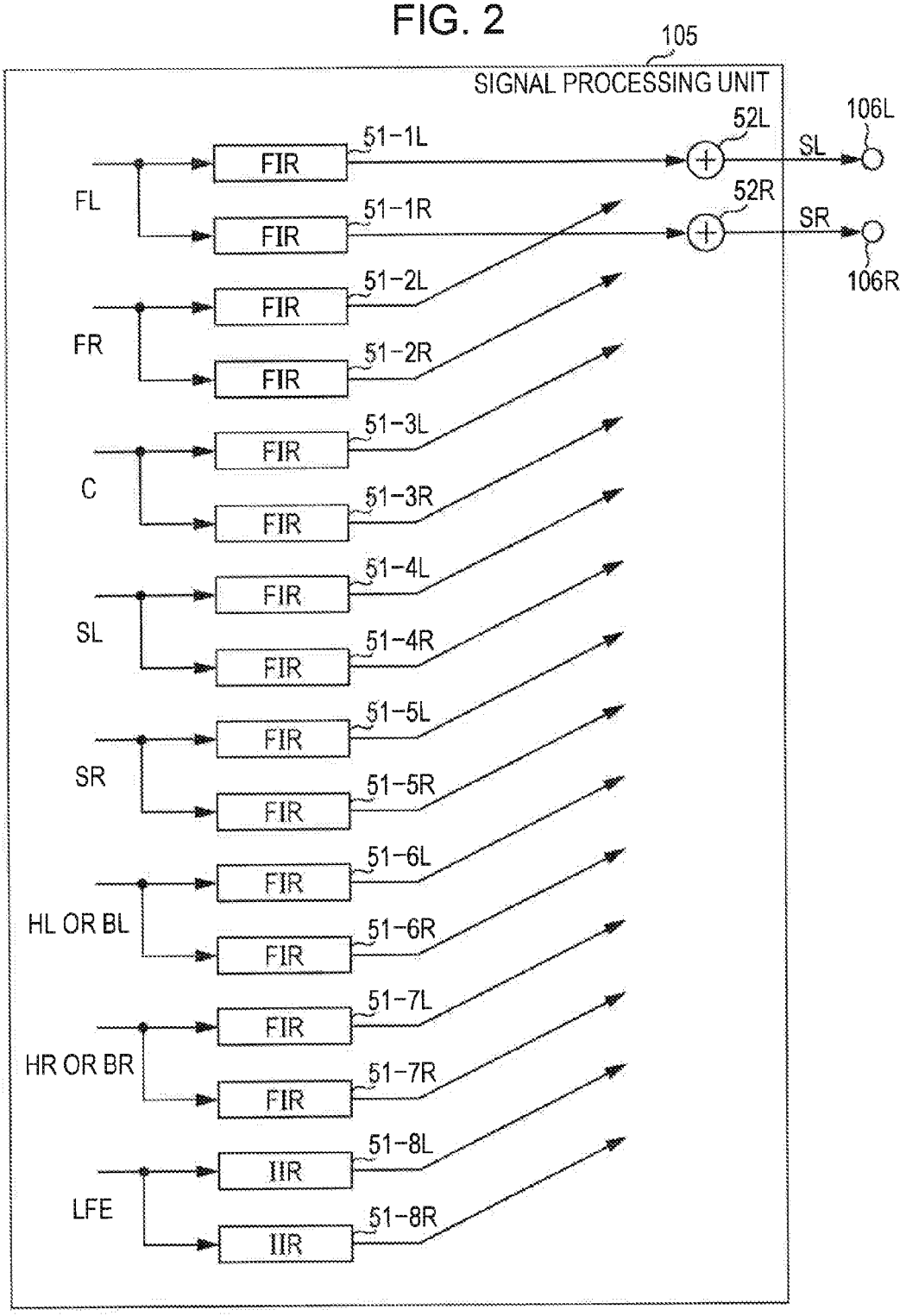
FIG. 2 is a block diagram illustrating an example of the configuration of a signal processing unit included in the audio-signal processing device.
Figure 3:
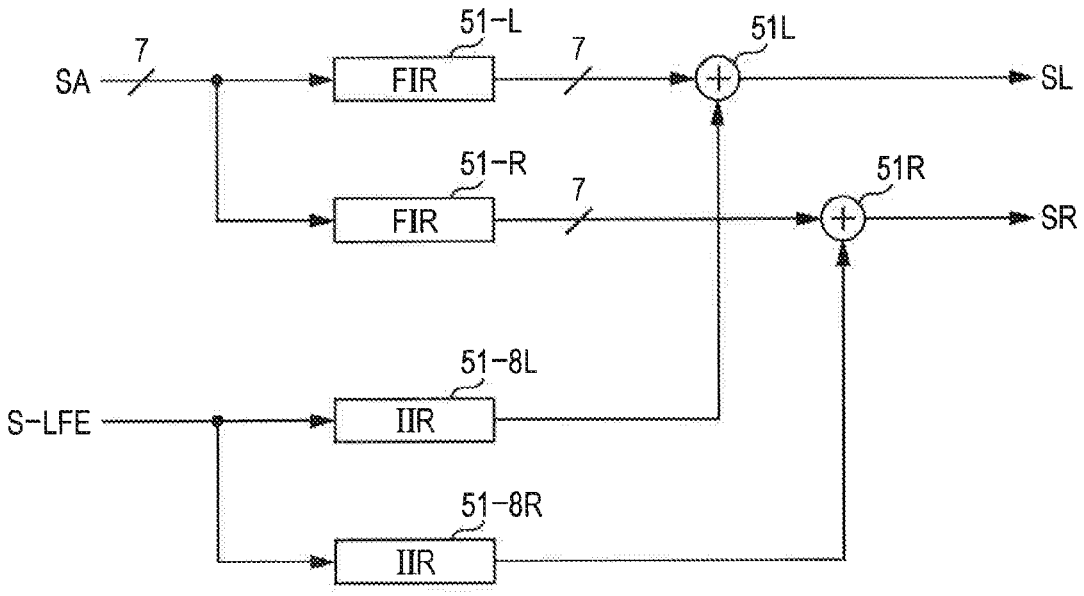
FIG. 3 illustrates a configuration in which digital filters for processing audio signals S-LFE for a low-frequency enhancement channel (LFE) are implemented by IIR filters.

FIG. 2 illustrates an example of the configuration of the signal processing unit 105. FIR (finite impulse response) filters 51-1L and 51-1R are digital filters for processing the left-front channel (FL) audio signals. The FIR filter 51-1L convolves an impulse response for the path from the sound-source position of the left-front channel (FL) to the left ear of the listener with the left-front channel (FL) audio signals. The FIR filter 51-1R convolves an impulse response for the path from the sound-source position of the left-front channel (FL) to the right ear of the listener with the left-front channel (FL) audio signals.

FIR filters 51-2L and 51-2R are digital filters for processing the right-front channel (FR) audio signals. The FIR filter 51-2L convolves an impulse response for the path from the sound-source position of the right-front channel (FR) to the left ear of the listener with the right-front channel (FR) audio signals. The FIR filter 51-2R convolves an impulse response for the path from the sound-source position of the right-front channel (FR) to the right ear of the listener with the right-front channel (FR) audio signals.

FIR filters 51-3L and 51-3R are digital filters for processing the central channel (C) audio signals. The FIR filter 51-3L convolves an impulse response for the path from the sound-source position of the center channel (C) to the left ear of the listener with the center channel (C) audio signals. The FIR filter 51-3R convolves an impulse response for the path from the sound-source position of the center channel (C) to the right ear of the listener with the center channel (C) audio signals.

FIR filters 51-4L and 51-4R are digital filters for processing the left-rear channel (SL) audio signals. The FIR filter 51-4L convolves an impulse response for the path from the sound-source position of the left-rear channel (SL) to the left ear of the listener with the left-rear channel (SL) audio signals. The FIR filter 51-4R convolves an impulse response for the path from the sound-source position of the left-rear channel (SL) to the right ear of the listener with the left-rear channel (SL) audio signals.

FIR filters 51-5L and 51-5R are digital filters for processing the right-rear channel (SR) audio signals. The FIR filter 51-5L convolves an impulse response for the path from the sound-source position of the right-rear channel (SR) to the left ear of the listener with the right-rear channel (SR) audio signals. The FIR filter 51-5R convolves an impulse response for the path from the sound-source position of the right-rear channel (SR) to the right ear of the listener with the right-rear channel (SR) audio signals.

FIR filters 51-6L and 51-6R are digital filters for processing the audio signals for the left-front high channel (FL) or the left-back surround channel (FL). The FIR filter 51-6L convolves an impulse response for the path from the sound-source position of the left-front high channel (HL) or the left-back surround channel (HL) to the left ear of the listener with the left-front high channel (HL) or the left-back surround channel (BL) audio signals. The FIR filter 51-6R convolves an impulse response for the path from the sound-source position of the left-front high channel (HL) or the left-back surround channel (FL) to the right ear of the listener with the left-front high channel (HL) or the left-back surround channel (BL) audio signals.

FIR filters 51-7L and 51-7R are digital filters for processing the audio signals for the right-front high channel (HR) or the right-back surround channel (BR). The FIR filter 51-7L convolves an impulse response for the path from the sound-source position of the right-front high channel (HF) or the right-back surround channel (BR) to the left ear of the listener with the right-front high channel (HR) or the right-back surround channel (BR) audio signals. The FIR filter 51-7R convolves an impulse response for the path from the sound-source position of the right-front high channel (HR) or the rightback surround channel (BR) to the right ear of the listener with the right-front high channel (HR) or the right-back surround channel (BR) audio signals.

IIR filters 51-8L and 51-8R are digital filters for processing the low-frequency enhancement channel (LFE) audio signals (subwoofer signals). The IIR filter 51-8L convolves an impulse response for the path from the sound-source position of the low-frequency enhancement channel (LFE) to the left ear of the listener with the low-frequency enhancement channel (LFE) audio signals. The IIR filter 51-8R convolves an impulse response for the path from the sound-source position of the low-frequency enhancement channel (LFE) to the right ear of the listener with the low-frequency enhancement channel (LFE) audio signals.

An adder 52L adds signals output from the FIR filters 51-1L, 51-2L, 51-3L, 51-4L, 51-5L, 51-6L, and 51-7L and a signal output from the IIR filter 51-8L to generate left-channel audio signals SL and outputs the left-channel audio signals SL to the output terminal 106L. An adder 52R adds signals output from the FIR filters 51-1R, 51-2R, 51-3R, 51-4R, 51-5R, 51-6R, and 51-7R and a signal output from the IIR filter 51-8R to generate right-channel audio signals SR and outputs the right-channel audio signals SR to the output terminal 106R.

Figure 4:
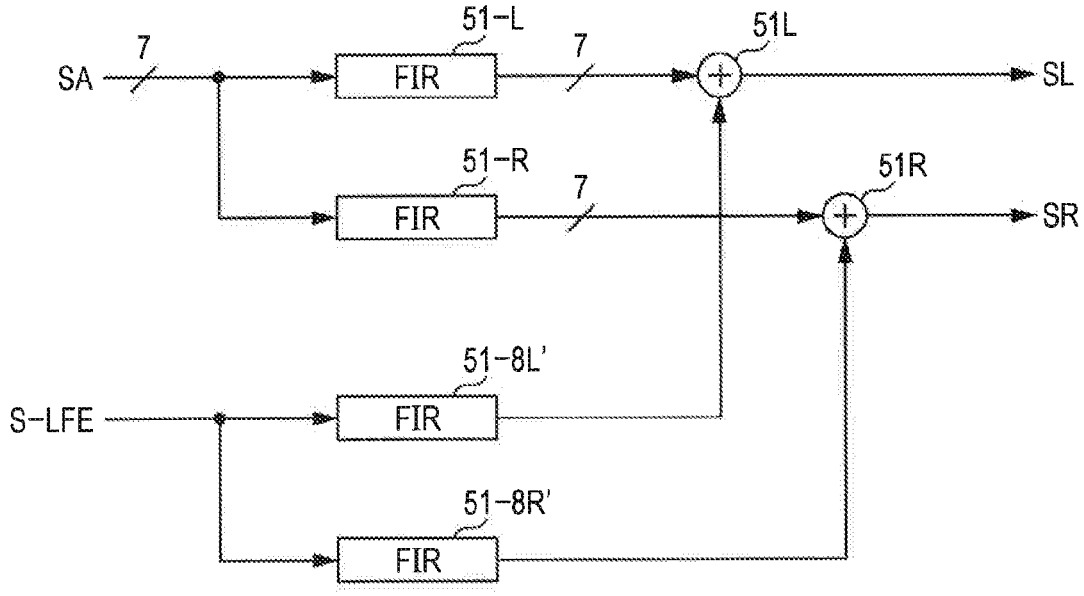
FIG. 4 illustrates a configuration in which the digital filters for processing the audio signals S-LFE for the low-frequency enhancement channel (LFE) are implemented by FIR filters.

As illustrated in FIG, 3, in the signal processing unit 105, the digital filters for processing the audio signals S-LFE for the low-frequency enhancement channel (LFE) are implemented by the IIR filters 51-8L and 51-8R and the digital filters for processing the audio signals SA for the other channels are implemented by the FIR filters 51-L and 51-R. As illustrated in FIG. 4, the digital filters for processing the audio signals S-LFE for the low-frequency enhancement channel (LFE) may also be implemented by FIR filters 51-8L' and 51-8R'.

However, when the FIR filters 51-8L' and 51-8R' are used, the tap length increases and the amounts of memory and computation also increase because of the low frequency of the audio signals S-LFE for the low-frequency enhancement channel (LFE). In contrast, when the IIR filters 51-8L and 51-8R are used, the low frequency can be enhanced with high accuracy and the amounts of memory and computation can be reduced. It is, therefore, preferable that the IIR filters 51-8L and 51-8R be used to constitute the digital filters for processing the audio signals S-LFE for the low-frequency enhancement channel (LFE).

Figure 5:
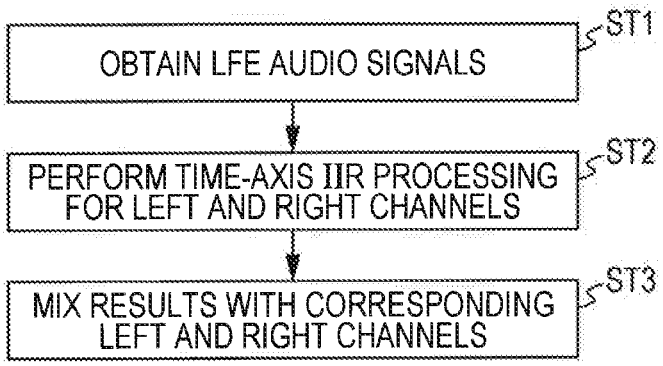
FIG. 5 is a flowchart illustrating an overview of a procedure of processing, performed by the signal processing unit, for the low-frequency enhancement channel (LFE) audio signals.

A flowchart in FIG. 5 illustrates an overview of a procedure of processing, performed by the signal processing unit 105, for the low-frequency enhancement channel (LFE) audio signals. First, in step ST1, the signal processing unit 105 obtains low-frequency enhancement channel (LFE) audio signals from the decoding unit 103. In step ST2, the IIR filters 51-8L and 51-8R in the signal processing unit 105 perform processing for convolving the impulse responses with the low-frequency enhancement channel (LFE) audio signals. In step ST3, the signal processing unit 105 mixes (adds) the convolution processing results obtained by the IIR filters 51-8L and 51-8R with (to) the corresponding convolution processing results of other left and right channels.

Figure 6:
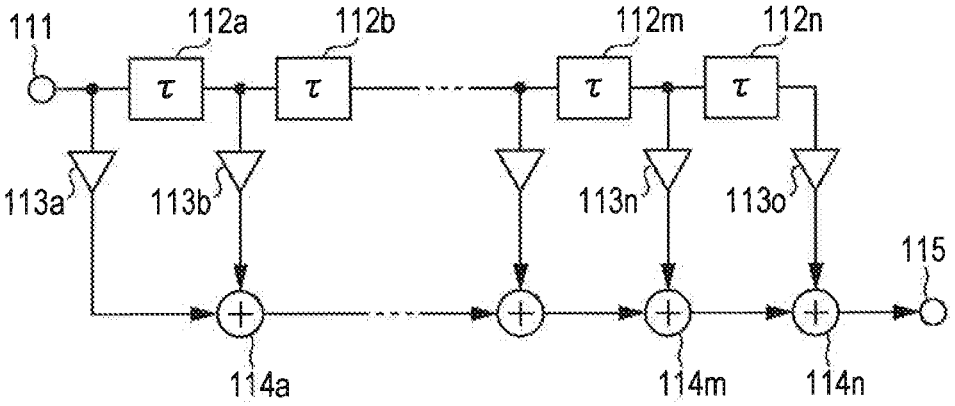
FIG. 6 is a block diagram illustrating an example of the configuration of an FIR filter.

FIG. 6 illustrates an example of the configuration of an FIR filter. A signal obtained at an input terminal 111 is supplied to a series circuit of delay circuits 112*a*, 112*b*, . . . , 112*m*, and 112*n* continuously connected in multiple stages. The signal obtained at the input terminal 111 and signals output from the delay circuits 112*a*, 112*b*, . . . , 112*m*, and 112*n* are supplied to corresponding individual coefficient adders 113*a*, 113*b*, . . . , 113*n*, and 113*o* and are multiplexed by corresponding individually set coefficient values. The resulting coefficient multiplication signals are sequentially added. by adders 114*a*, 114*b*, . . . , 114*m*, and 114*n* and an addition output of all of the coefficient multiplication signals is output from an output terminal 115.

Figure 7:
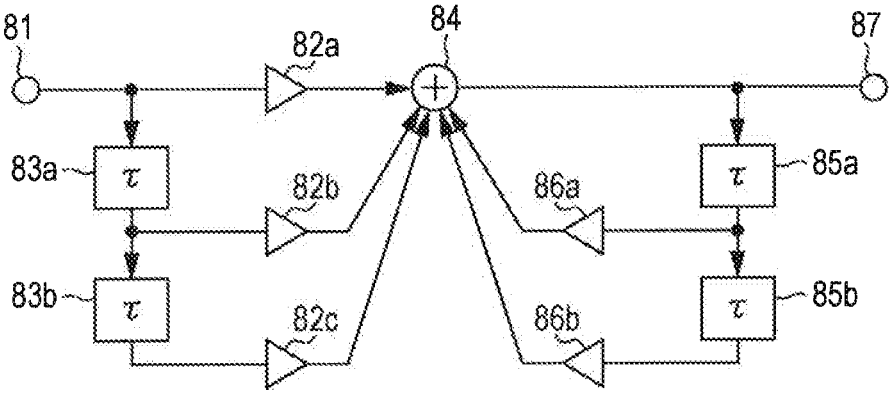
FIG. 7 is a block diagram illustrating an example of the configuration of an IIR filter.

FIG. 7 illustrates an example of the configuration. of an IIR filter. An input signal obtained at an input terminal 81 is supplied to an adder 84 via a coefficient multiplier 82*a*. The input signal is also delayed by a delay circuit 83*a* and is then supplied to the adder 84 via a coefficient multiplexer 82*b*. An output of the delay circuit 83*a* is delayed by a delay circuit 83*b* and is then supplied to the adder 84 via a coefficient multiplexer 82*c*.

An addition output of the adder 84 is supplied to an output terminal 87. The addition output is also delayed by a delay circuit 85*a* and is then supplied to the adder 84 via a coefficient multiplexer 86*a*. An output of the delay circuit 85*a* is delayed by a delay circuit 85*b* and is then supplied to the adder 84 via a coefficient multiplexer 86*b*. The adder 84 performs processing for adding the supplied signals to obtain an addition output.

Referring back to FIG. 1, under the control of the control unit 101, the coefficient setting unit 104 sets filter coefficients corresponding to the impulse responses for the digital filters in the signal processing unit 105, on the basis of the format of the compressed audio stream Ast and the decode-mode information of the post decoder 103*b*. In this case, the coefficient setting unit 104 sets, for the digital filters for the channels indicated by the decode-mode information of the decoding unit 103, filter coefficients corresponding to estimated channel positions determined by the format information.

The coefficient setting unit 104 has a coefficient holding unit 104*a* and an FFT (Fast Fourier Transform) unit 104*b*. The coefficient holding unit 104*a* holds actual-time coefficient data (time-series coefficient data) as the filter coefficients corresponding to the impulse responses. The FFT unit 104*b* reads the actual-time coefficient data held by the coefficient holding unit 104*a*, transforms the actual-time coefficient data into frequency-domain data, and sets the frequency-domain data for the digital filters in the signal processing unit 105. Although not described above, each digital filter in the signal processing unit 105 performs the impulse--response convolution in a frequency domain.

Figure 8:
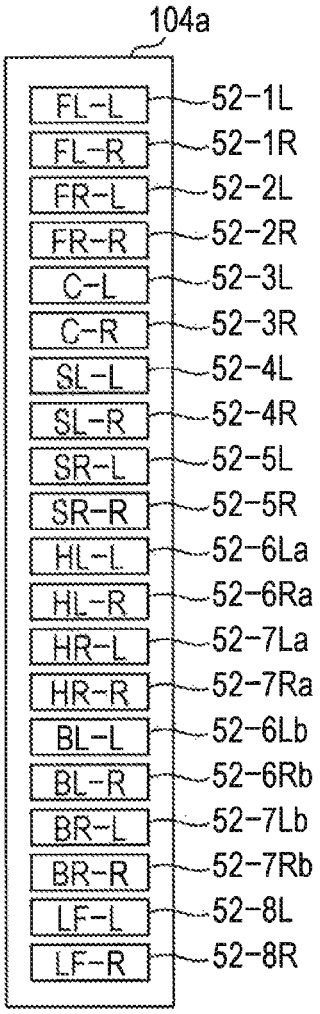
FIG. 8 illustrates one example of actual-time coefficient data (filter coefficients) held by a coefficient holding unit.

FIG. 8 illustrates actual-time coefficient data (filter coefficients) held by the coefficient holding unit 104*a*. That is, coefficient data 52-1L and 52-1R represent coefficient data FL-L and FL-R to be set for the FIR filters 51-1L, and 51-1R, respectively, in the signal processing unit 105, It is assumed that the coefficient data FL-L and FL-R include coefficient data corresponding to each estimated format of the compressed audio stream Ast input to the input terminal 102. This is also true for the coefficients data to be set for the other digital filters in the signal processing unit 105, although details are not described herein.

Coefficient data 52-2L and 52-2R represent coefficient data FR-L and FR-R to be set for the FIR filters 51-2L and 51-2R, respectively, in the signal processing unit 105. Coefficient data 52-3L and 52-3R represent coefficient data C-L and C-R to be set for the FIR filters 51-3L and 51-3R, respectively, in the signal processing unit 105. Coefficient data 52-4L and 52-4R represent coefficient data SL-L and SL-R to he set for the FIR filters 51-4L and 51-4R, respectively, in the signal processing unit 105.

Coefficient data 52-5L and 52-5R represent coefficient data SR-L and SR-R to be set for the FIR filters 51-5L and 51-5R, respectively, in the signal processing unit 105. Coefficient data 52-6La and 52-6Ra represent coefficient data HL-L and HL-R to be set for the FIR filters 51-6L and 51-6R, respectively, in the signal processing unit 105. Coefficient, data 52-7ba and 52-7Ra represent coefficient data HR-L and HR-R to be set for the FIR filters 51-7L and 51-7R, respectively, in the signal processing unit 105.

Coefficient data 52-6Lb and 52-6Rb represent coefficient data BL-L and BL-R to be set for the FIR filters 51-6L and 51-6R, respectively, in the signal processing unit 105. Coefficient data 52-7Lb and 52-7Rb represent coefficient data BR-L and BR-R to be set for the FIR filters 51-7L and 51-7R, respectively, in the signal processing unit 105. Coefficient data 52-8L and 52-8R represent coefficient data LF-L and LF-R to he set for the IIR filters 51-8L and 51-8R, respectively, in the signal processing unit 105.

Figure 9B:
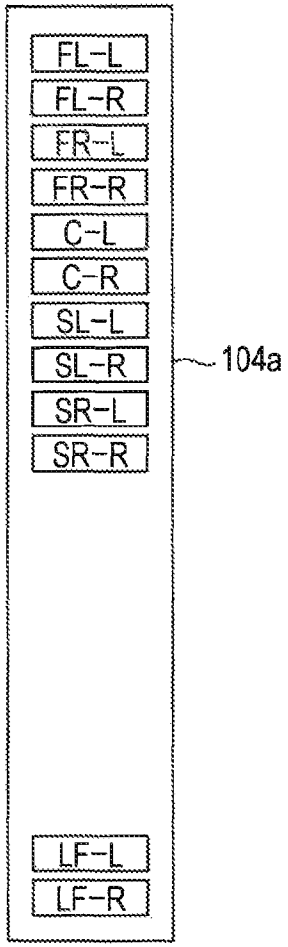
FIGS. 9A and 9B illustrate one example of a relationship between a listener M and an estimated channel layout when the format of a compressed audio stream Ast is a 5.1-channel format.
Figure 9A:
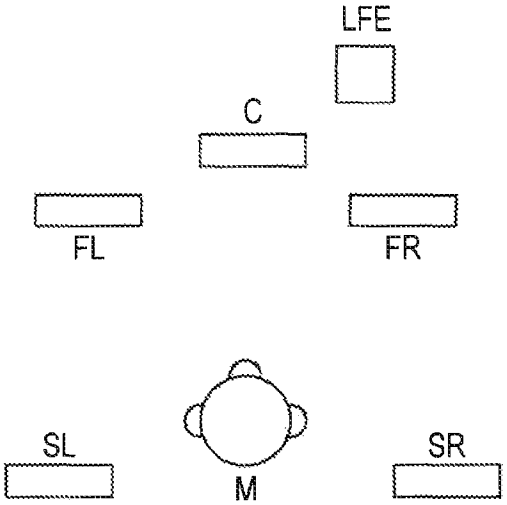

FIG. 9A illustrates one example of a relationship between a listener M and an estimated channel layout when the decode mode of the decoding unit 103 is a 5.1-channel mode. In this case, as illustrated in FIG. 9B, filter coefficients corresponding to the estimated channel layout are set for the digital filters, provided in the signal processing unit 105, for the front channels (FL and FR), the center channel (C), the rear channels (SL and SR), and the low-frequency enhancement channel (LFE).

Figure 10B:
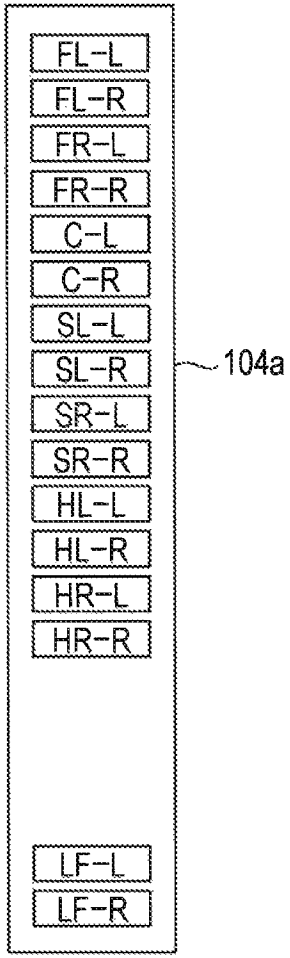
FIGS. 10A and 10B illustrate one example of a relationship between the listener M and an estimated channel layout when the format of the compressed audio stream Ast is a 7.1-channel format in which audio signals for front high channels are included.
Figure 10A:
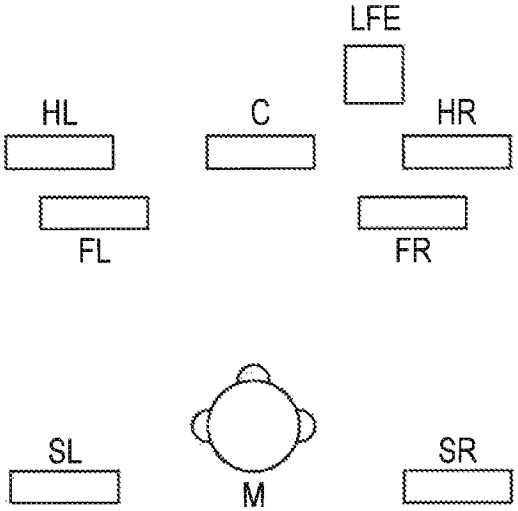

FIG. 10A illustrates one example of a relationship between the listener M and an estimated channel layout when the decode mode of the decoding unit 103 is a 7.1-channel mode in which the audio signals for the front high channels (HL and HR) are included. In this case, as illustrated in FIG. 10B, filter coefficients for the estimated channel layout are set for the digital filters, provided in the signal processing unit 105, for the front channels (FL and FR), the center channel (C), the rear channels (SL and SR), the front high channels (HL and HR), and the low-frequency enhancement channel (LFE).

Figure 11B:
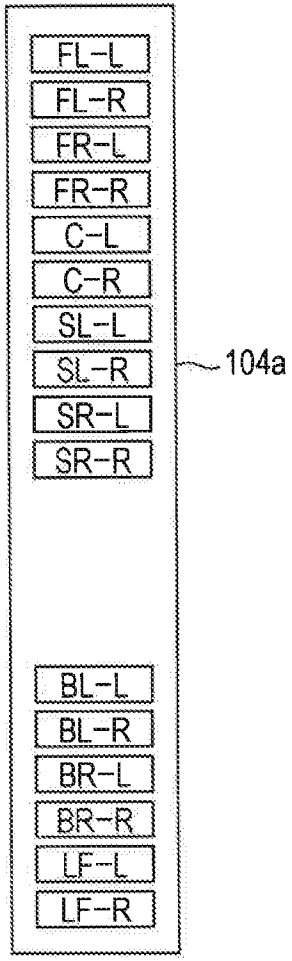
FIGS. 11A and 11B illustrate one example of a relationship between the listener H and an estimated channel layout when the format of the compressed audio stream Ast is a 7.1-channel format in which audio signals for back surround channels are included.
Figure 11A:
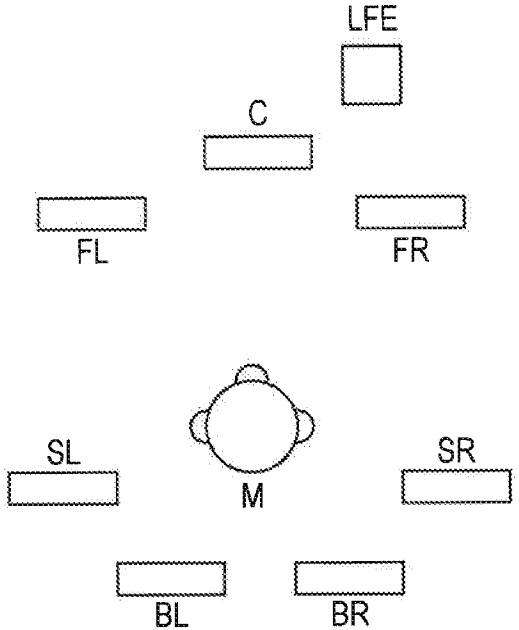

FIG. 11A illustrates one example of a relationship between the listener M and an estimated channel layout when the decode mode of the decoding unit 103 is a 7.1-channel mode in which the audio signals for the back surround channels are included. In this case, as illustrated in FIG. 11B, filter coefficients for the estimated channel layout are set for the digital filters for the front channels (FL and FR), the center channel (C), the rear channels (SL and SR), the back surround channels (BL and BR), and the low-frequency enhancement channel (LFE) in the signal processing unit 105.

Figure 12:
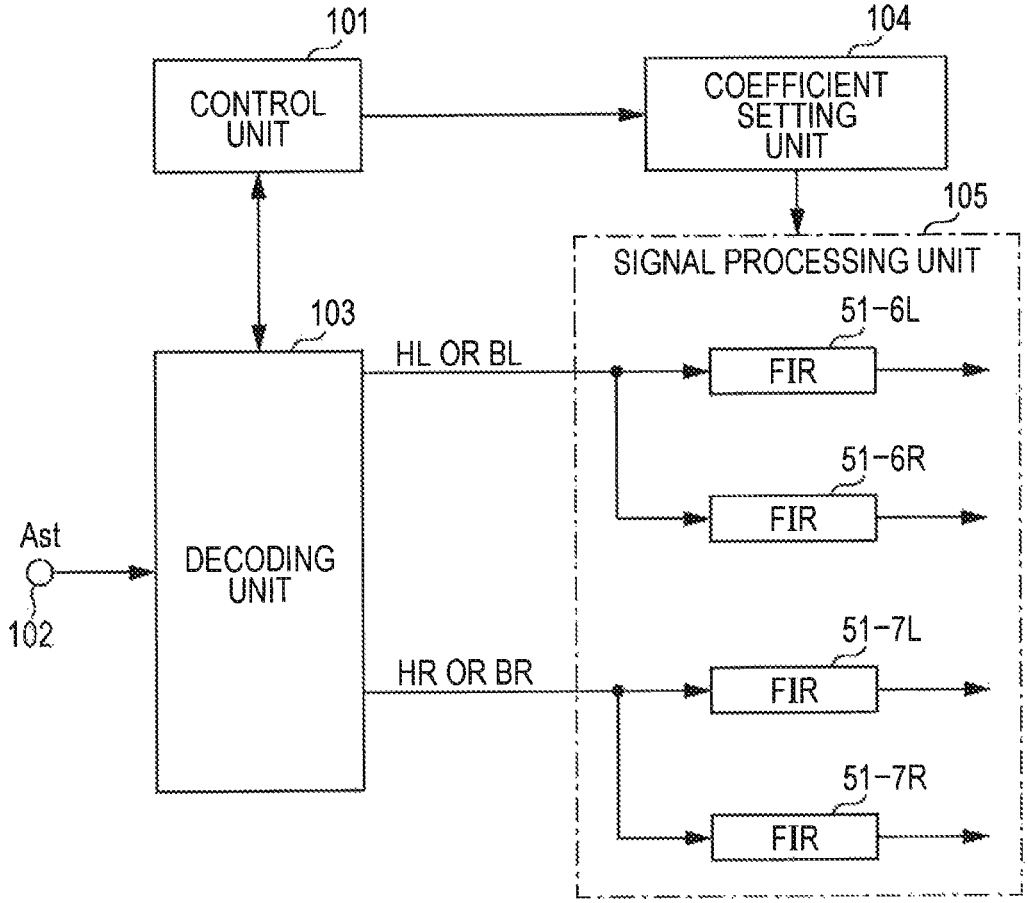
FIG. 12 is a block diagram mainly illustrating FIR filters for processing audio signals for front high channels (HL and HR) or back surround channels (BL and BR)

FIG. 12 is a block diagram illustrating the FIR filters 51-6L, 51-6R, 51-7L, and 51-7R, provided in the signal processing unit 105, for processing the audio signals for the front high channels (HL and HR) or the back surround channels (HL and BR). The coefficient setting unit 104 sets filter coefficients for the front high channels for the FIR. filters 51-6L, 51-6R, 51-7L, and 51-7R, when the decode mode of the decoding unit 103 is a 7.1-channel mode in which the audio signals for the front high channels are included. On the other hand, the coefficient setting unit 104 sets filter coefficients for the back surround channels for the FIR filters 51-6L, 51-6R, 51-7L, and 51-7R, when the decode mode of the decoding unit 103 is a 7.1-channel mode in which the audio signals for the back surround channels are included.

Figure 13:
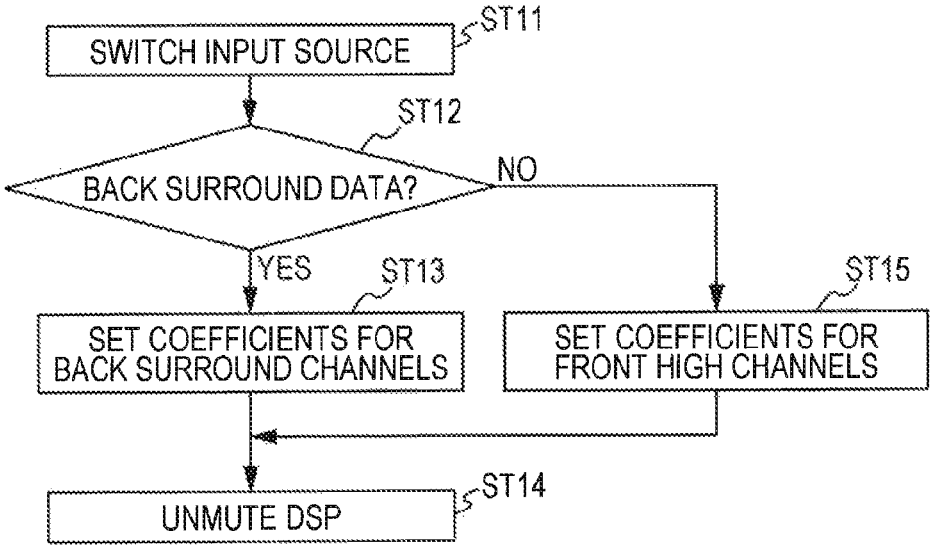
FIG. 13 is a flowchart illustrating one example of a procedure for processing, performed by a coefficient setting unit, for setting filter coefficients for the FIR filters for processing the audio signals for the front high channels or the back surround channels.

FIG. 13 is a flowchart illustrating one example of a procedure for processing, performed by the coefficient setting unit 104, for setting filter coefficients for the FIR filters for processing audio signals for the front high channels or back surround channels. When an input source (an output of the decoding unit 103) is switched to a 7.1 channel format in step ST11, the process of the coefficient setting unit 104 proceeds to step ST12.

In step ST12, the coefficient setting unit 104 determines whether or not audio signals (audio data) for the back surround channels are included. When audio signals for the back surround channels are included, the process proceeds to step ST13 in which the coefficient setting unit 104 sets a set of coefficients for the back surround channels for the corresponding digital filters (FIR filters) Thereafter, in step ST14, the coefficient setting unit 104 unmutes the signal processing unit (DSP) 105.

When it is determined in step ST12 that audio signals for the back surround channels are not included, that is, when audio signals for the front high channels are included, the process proceeds to step ST15 in which the coefficient setting unit 104 sets a set of coefficients for the front high channels for the digital filters (FIR filters). Thereafter, in step ST14, the coefficient setting unit 104 unmutes the signal processing unit (DSP) 105.

Figure 14:
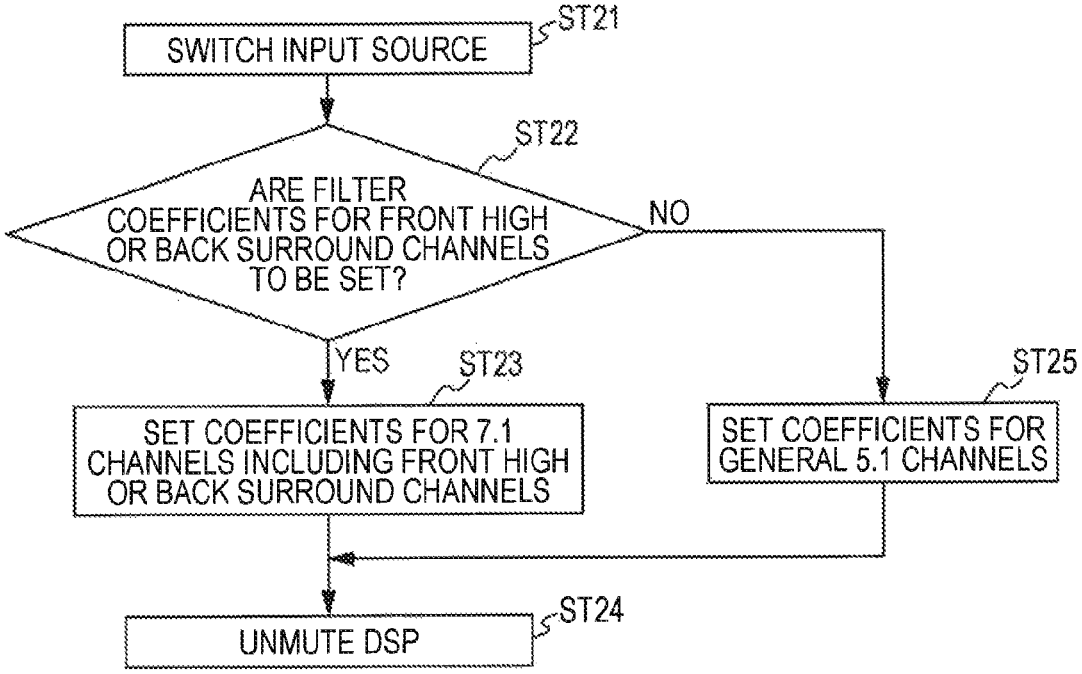
FIG. 14 is a flowchart illustrating one example of a procedure for processing, performed by the coefficient setting unit, for setting filter coefficients for the FIR filters for processing the audio signals for the front high channels (HL and HR) or the back surround channels (BL and BR)

FIG. 14 is a flowchart illustrating one example of a procedure for processing for setting filter coefficients for the FIR filters 51-6L, 51-6R, 51-7L, and 51-7R, provided in the coefficient setting unit 104, for processing the audio signals for the front high channels (HL and HR) or the back surround channels (BL and BR). When an input source (the output of the decoding unit 103) is switched in step ST21, the process of the coefficient setting unit 104 proceeds to step ST22.

In step ST22, the coefficient setting unit 104 determines whether or not filter coefficients are to be set for the FIR filters for processing the audio signals for the front high channels (HL and HR) or the back sound channels (BL and BR). When the format of the output of the decoding unit 103 is a 7.1-channel format and it is determined in step ST22 that filter coefficients are to be set for the FIR filters, the process proceeds to step ST23 in which the coefficient setting unit 104 sets filter coefficients for the digital filters for processing the audio signals for the channels including the front high channels (HL and HR) or the back surround channels (BL and BR). Thereafter, in step ST24, the coefficient setting unit 104 unmutes the signal processing unit (DSP) 105.

When the format of the output of the decoding unit 103 is a 5.1-channel format and it is determined in step ST22 that filter coefficients are not to be set for the FIR filters, the process proceeds to step ST25 in which the coefficient setting unit 104 sets filter coefficients for the digital filters for processing the audio signals for the channels of the general 5.1 channels, other than the front high channels (HL and HR) or the back surround channels (BL and BR). Thereafter, in step ST24, the coefficient setting unit 104 unmutes the signal processing unit (DSP) 105.

Figure 15:
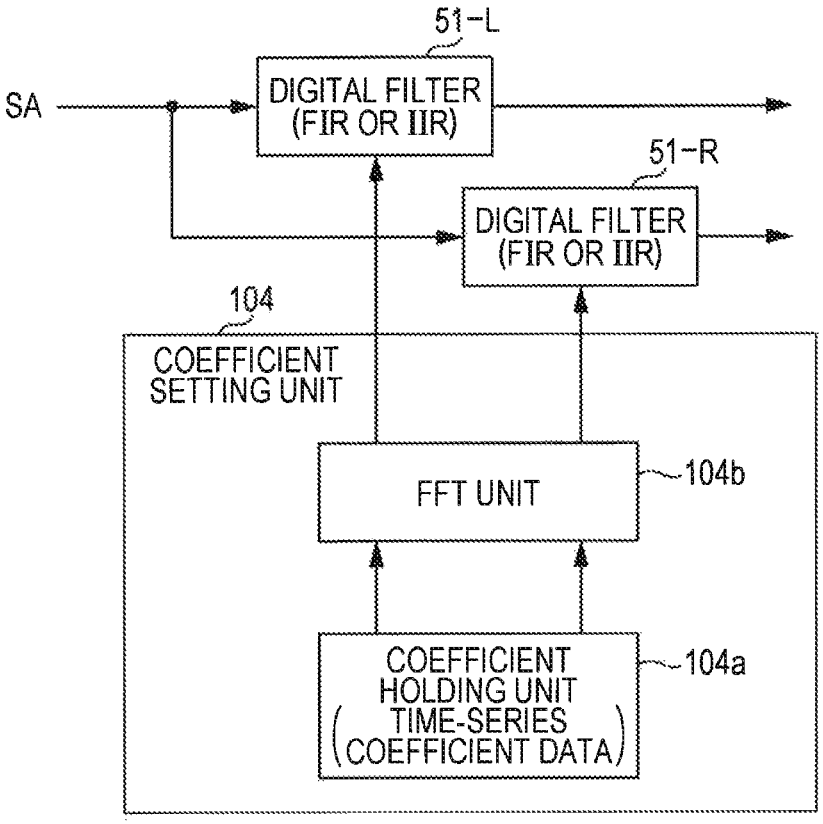
FIG. 15 illustrates an example in which time-series coefficient data are held in the coefficient holding unit in the coefficient setting unit as filter coefficients corresponding to impulse responses.
Figure 16:
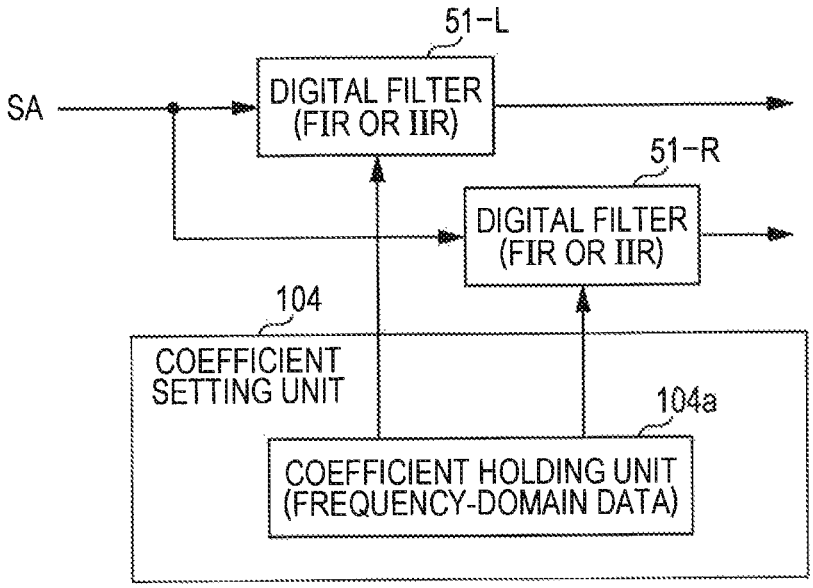
FIG. 16 illustrates an example in which frequency-domain data can also be held in the coefficient holding unit.

As illustrated in FIG. 15, the coefficient holding unit 104*a* in the coefficient setting unit 104 holds the time-series coefficient data as the filter coefficients corresponding to the impulse responses. The actual-time coefficient data are transformed into frequency-domain data, which are set for the digital filters 51-L and 51-R, provided in the signal processing unit 105, for processing the audio signals for the channels. As illustrated in FIG. 16, the arrangement may also be such that the coefficient holding unit 104*a* holds the frequency-domain data and the coefficient setting unit 104 directly sets the frequency-domain data for the digital filters 51-L and 51-R, provided in the signal processing unit 105, for processing the audio signals for the channels.

In the present embodiment, however, it is preferable to employ a configuration in which the coefficient holding unit 104*a* holds the time-series coefficient data as the filter coefficients, the time-series coefficient data are transformed into frequency-domain data, and the frequency-domain data are set for the digital filters 51-L and 51-R. The reason is that holding the time-series coefficient data as the filter coefficients makes it possible to reduce the amount of memory in the coefficient holding unit 104*a*, compared to a case in which the frequency-domain data are held as the filter coefficients.

Figure 17:
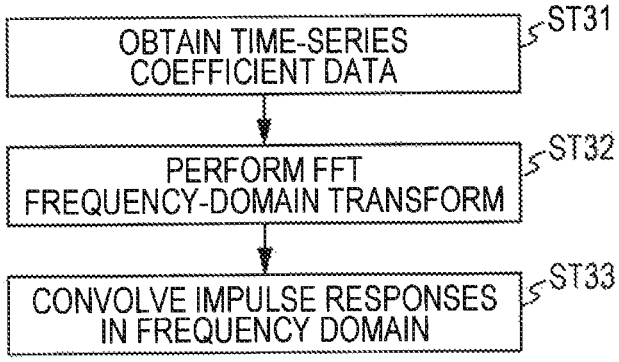
FIG. 17 is a flowchart illustrating one example of a procedure of processing, performed by the coefficient setting unit, for setting filter coefficients for the digital filters.

FIG. 17 is a flowchart illustrating one example of a procedure of processing, performed by the coefficient setting unit 104, for setting the filter coefficients for the digital filters 51-L and 51-R. First, in step ST31, the coefficient setting unit 104 obtains the time-series coefficient data from the coefficient holding unit 104*a*. In step ST32, the coefficient setting unit 104 uses the FFT unit 104*b* to transform the time-series coefficient data into frequency-domain data and sets the frequency-domain data for the digital filters 51-L and 51-R. As a result, in step ST33, the digital filters 51-L and 51-R can convolve the impulse responses in a frequency domain.

Figure 18:
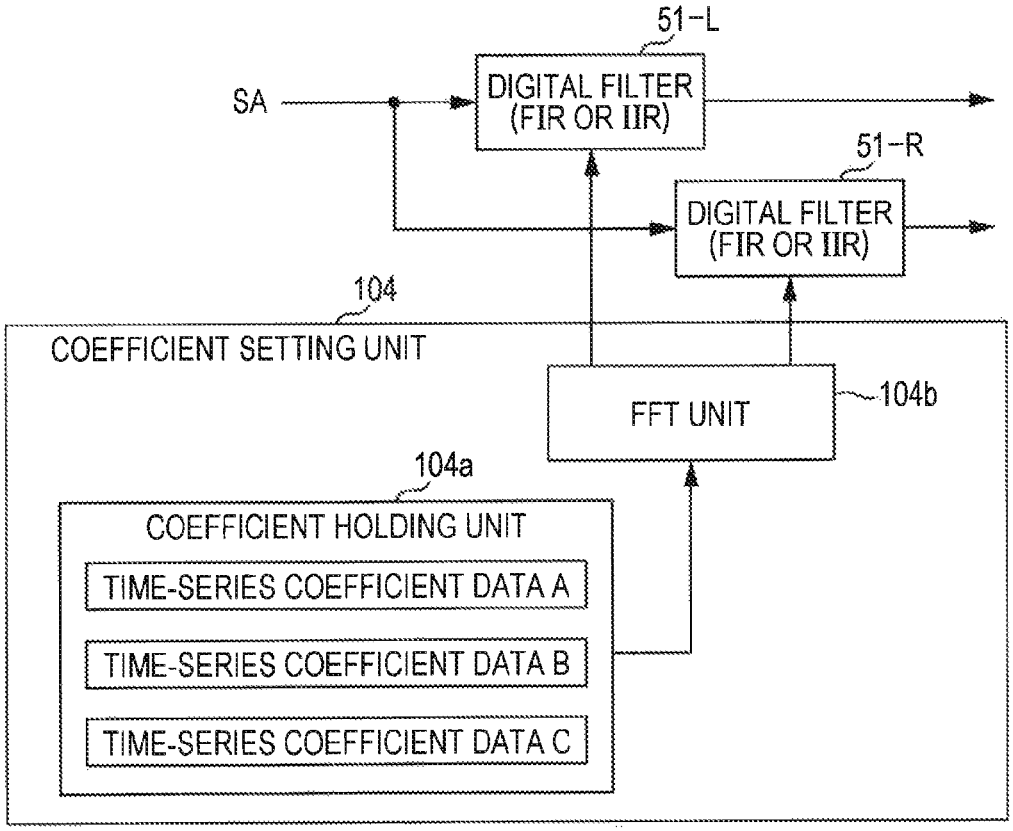
FIG. 18 illustrates one example in which the coefficient holding unit holds time-series coefficient data to be shared by multiple channels.

When the time-series coefficient data are held in the coefficient holding unit 104*a* as the filter coefficients, part of the time-series coefficient data can be shared by the multiple channels and the amount of memory in the coefficient holding unit 104*a* can be further reduced. FIG. 18 illustrates one example in which the coefficient holding unit 104*a* holds time-series coefficient data to be shared by multiple channels.

Time-series coefficient data A is, for example, data of direct-sound part of a first channel, for example, a front channel (a front low channel) and time-series coefficient data B is, for example, data of direct-sound part of a second channel, for example, a front high channel. Time-series coefficient data C is reverberation part (indirect-sound part) data to be shared by those two channels.

That is, for setting the filter coefficients for the digital filters 51-L and 51-R with respect to the first channel, the coefficient setting unit 104 obtains the time-series coefficient data A and C from the coefficient holding unit 104*a*, uses the FFT unit 104*b* to transform the time-series coefficient data A and C into frequency-domain data and sets the frequency-domain data for the digital filters 51-L and 51-R. On the other hand, for setting the filter coefficients for the digital filters 51-L and 51-R with respect to the second channel, the coefficient setting unit 104 obtains the time-series coefficient data B and C from the coefficient holding unit 104*a*, uses the FFT unit 104*h* to transform the time-series coefficient data B and C into frequency-domain data, and sets the frequency-domain data for the digital filters 51-L and 51-R.

Although the above description has been given of an example in which the time-series coefficient data are shared by multiple channels, the present technology is not limited thereto. For example, with respect to one channel, the arrangement may be such that direct-sound part data are independently held so as to correspond to multiple formats of the compressed audio stream Ast and common data is used for reverberation part (indirect-sound part) data. In such a case, when the format of the compressed audio stream Ast is changed, the coefficient setting unit 104 can deal with the change by transforming only direct-sound part data corresponding to the changed format of the compressed audio stream Ast into frequency-domain data and setting the frequency-domain data for the digital filters.

Figure 19:
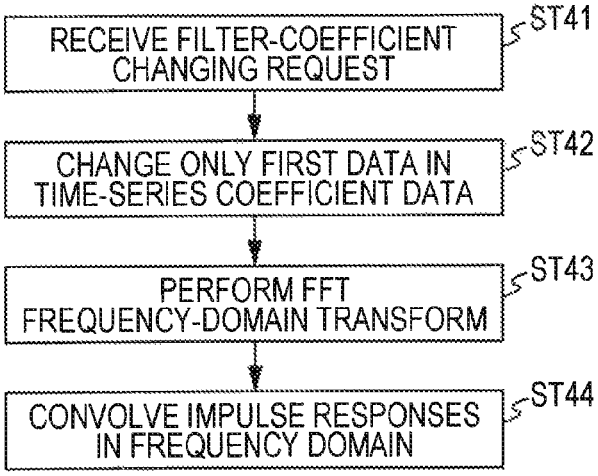
FIG. 19 is a flowchart illustrating one example of a procedure of processing performed by the coefficient setting unit when only direct-sound part data are transformed into frequency-domain data and the frequency-domain data are set for the digital filters.

FIG. 19 is a flowchart illustrating one example of a procedure of processing performed by the coefficient setting unit 104 in the case described above. In step ST41, the coefficient setting unit 104 receives a filter-coefficient changing request from the control unit 101. In step ST42, in order to change only the direct-sound part data that is the first piece of data in the time-series coefficient data corresponding to the change request, the coefficient setting unit 104 obtains only the direct-sound part data from the coefficient holding unit 104*a*.

In step ST43, the coefficient setting unit 104 uses the FFT unit 104*b* to transform the direct-sound part data into frequency-domain data and sets the frequency-domain data for the digital filters 51-L and 51-R. As a result, in step ST44, the digital filters 51-L and 51-R can convolve the post-change impulse responses in a frequency domain.

Figure 20:
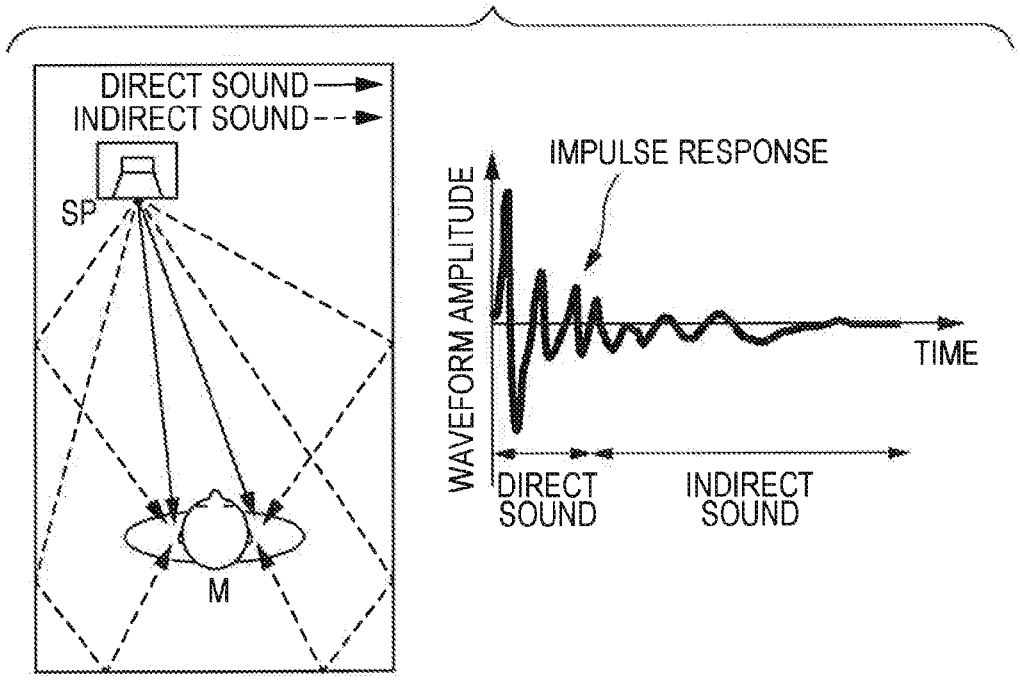
FIG. 20 illustrates acquisition of actual sound-field data.

Now, a description will be given of one example of a scheme for creating time-series coefficient data for the front high channels. This scheme utilizes actual-measurement data of the front channels (the front low channels). First, as illustrated in FIG. 20, for example, an impulse response from the speaker SP at the position of a front channel to microphones placed at the external-ear canal entrances at the auricles of a listener M in a viewing/listening room where reverberation occurs is obtained. The impulse response is divided into initial data and subsequent data, and the initial data and the subsequent data are used as "direct-sound coefficient data" and "indirect-sound coefficient data", respectively.

Figure 21A:
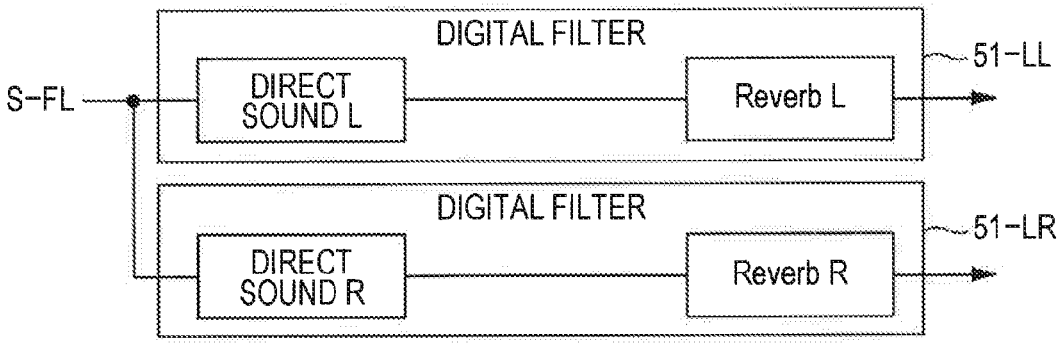
FIGS. 21A and 21B illustrate actual-sound-field data.
Figure 21B:
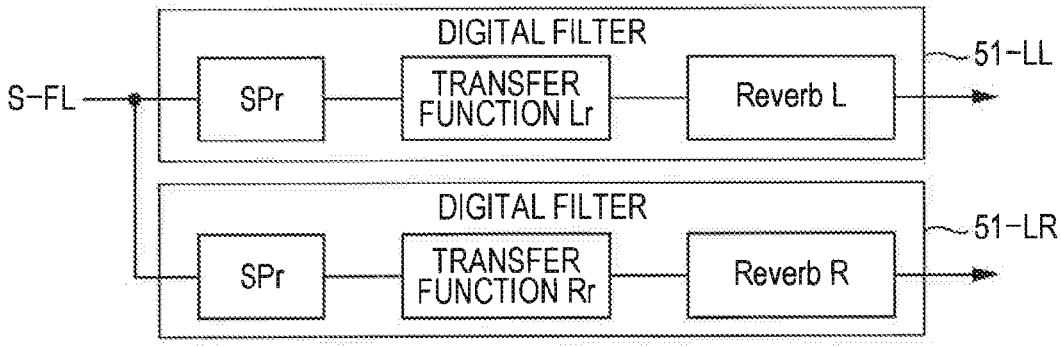

In this measurement, time-series coefficient data corresponding to the impulse responses, the time-series coefficient data being to be set for the digital filters (FIR filters) 51-LL and 51-LR for processing the audio signals 5-FL for the front channels (the front low channels), can be obtained as illustrated in FIG. 21A. In FIG. 21A, "direct sound L" and "direct sound R" represent the direct-sound part data and "Reverb L" and "Reverb R" represent reverberation part (indirect-sound part) data. In this case, since the direct sound L and the direct sound R include speaker characteristics SPr and transfer functions Lr and Rr, FIG. 21A can be represented as illustrated in FIG. 21B.

Figure 22:
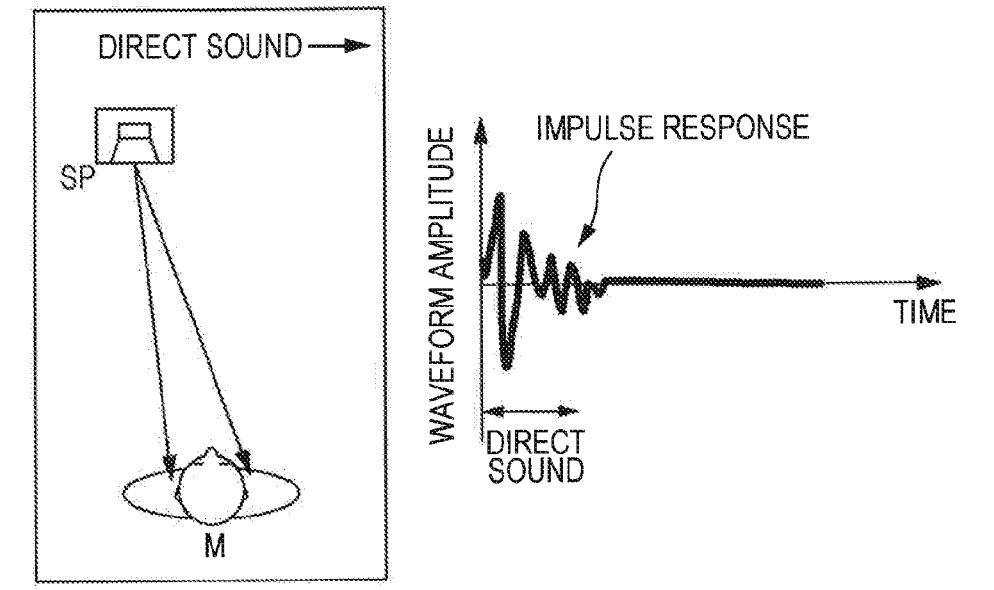
FIG. 22 illustrates acquisition of anechoic-room data.
Figure 23A:
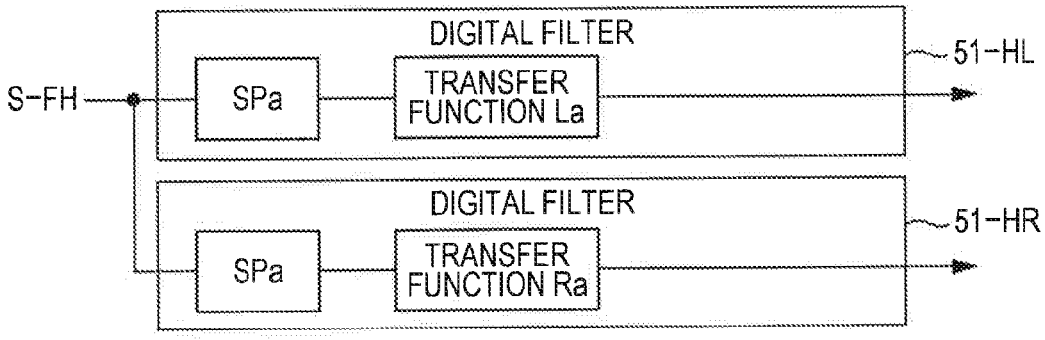
FIGS. 23A and 23B illustrate anechoic-room data.

Next, as illustrated in FIG. 22, an impulse response from the speaker SP at the position of the front high channel to microphones placed at the external-ear canal entrances at the auricles of the listener M in an anechoic room where no reverberation occurs is obtained. This impulse response is used as the direct-sound coefficient data. In this measurement, the direct-sound coefficient data to be set for the digital filters (FIR filters) 51-HL and 51-HR for processing the audio signals S-FH for the front high channels can be obtained as illustrated in FIG. 23A.

Figure 23B:
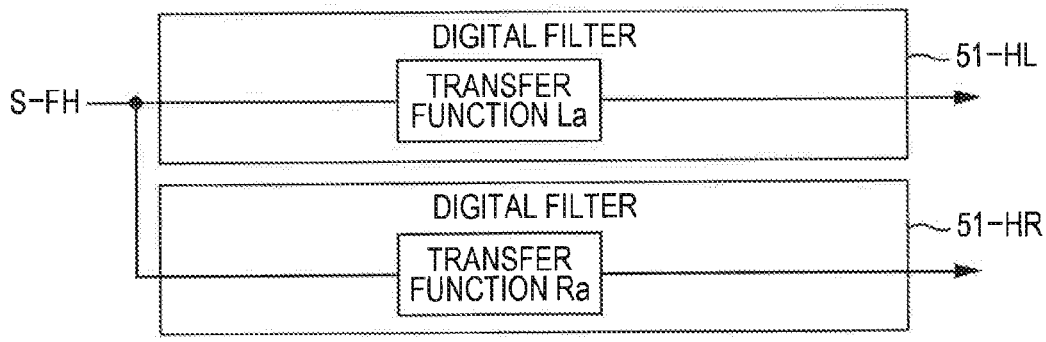

The direct-sound coefficient data includes speaker characteristics SPa and transfer functions La and Ra. Since the speaker characteristics SPa are known, the transfer functions La and Ra can be obtained from the measured direct-sound coefficient data. The speaker characteristics SPa can be normalized as illustrated in FIG. 23B. The speaker characteristics SPa can be obtained through measurement right in front of the speaker SP.

Final time-series coefficient data to be set for the digital filters (FIR filters) 51-HL and 51-HR for processing front high channel audio signals S-FH are generated based on the above-described actual-measurement data and the anechoic-room data. Thus, the generated time-series coefficient data is a combination of the actual-sound-field data and the anechoic-room data.

Figure 24:
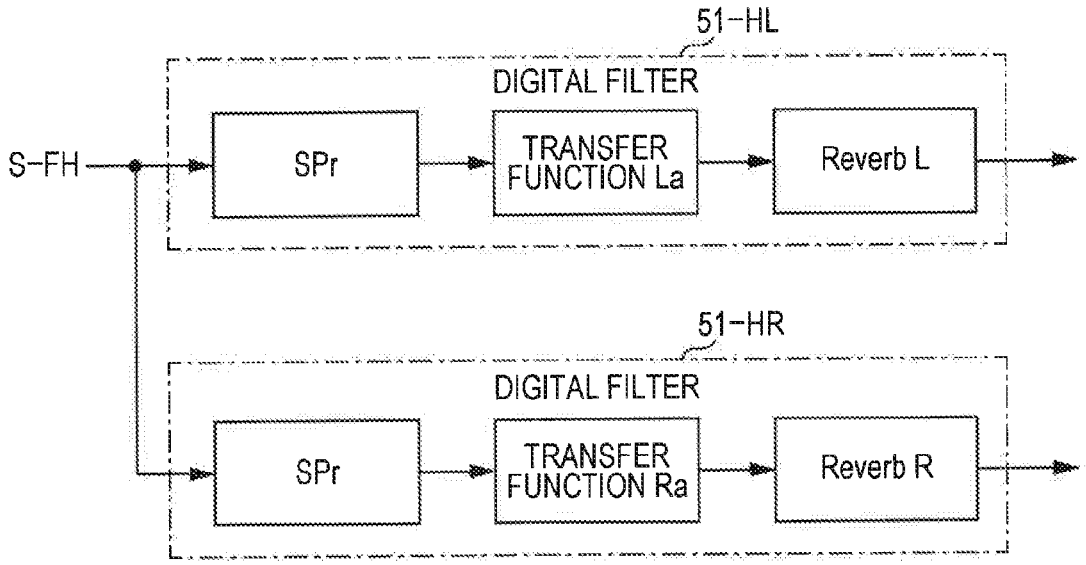
FIG. 24 illustrates time-series coefficient data that is obtained by combination of actual-sound-field data and anechoic-room data.
Figure 25A:
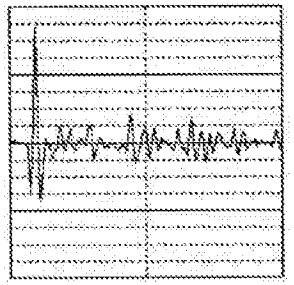
FIGS. 25A to 25G illustrate examples of an impulse response for direct sound L, reverberation-part data "Reverb L", direct sound R, reverberation-part data "Reverb R", transfer function La, transfer function Ra, and speaker characteristics SPr, respectively.
Figure 25B:
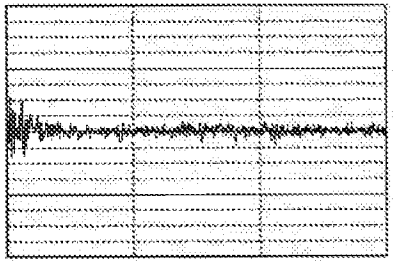
Figure 25C:
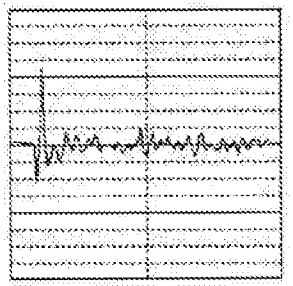
Figure 25D:
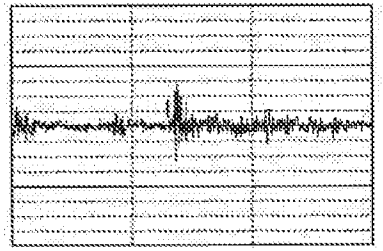
Figure 25E:
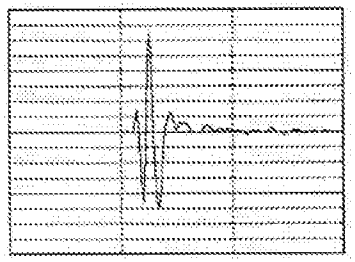
Figure 25F:
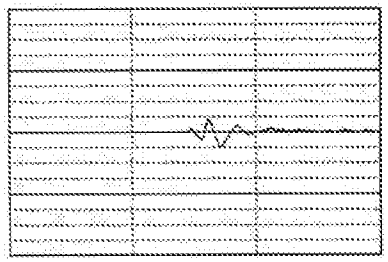
Figure 25G:
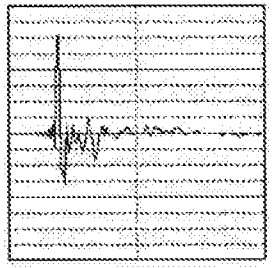

In this case, as illustrated in FIG. 24, the final time-series coefficient data to be set for the digital filter 51-HL includes the speaker characteristics SPr, the transfer function La, and the reverberation-part (indirect-sound part) data "Reverb L". This time-series coefficient data can be obtained by substituting the transfer function La for the transfer function Lr of the time-series coefficient data (see FIG. 21B) to be set for the digital filter 51-LL for processing the audio signals S-FL for the front channel (the front low channel).

Similarly, as illustrated in FIG. 24, the final time-series coefficient data to be set for the digital filter 51-HR includes the speaker characteristics SPr, the transfer function Ra, and the reverberation-part (indirect-sound part) data "Reverb R". This time-series coefficient data can be obtained by substituting the transfer function Ra for the transfer function Rr of the time-series coefficient data (see FIG. 21B) to be set for the digital filter 51-LR for processing the audio signals S-FR for the front channel (the front low channel)

FIGS. 25A to 25G illustrate examples of an impulse response for the direct sound L, the reverberation-part data "Reverb L", the direct sound R, the reverberation-part data "Reverb R", the transfer function La, the transfer function Ra, and the speaker characteristics SPr, respectively.

Creation of the time-series coefficient data for the front high channels by using a scheme as described above can facilitate that, for example, filter coefficients (time-series coefficient data) for the front high channels of 7.1 channels are obtained even for only a general 5.1-channel layout in an actual sound field. In this case, conditions of a sound field the listener wishes to reproduce are maintained and the relationship between the left channels and the right channels has the relationship in the anechoic room. Accordingly, it is possible to provide faithful sound-image localization and it is also possible to reproduce reverberation in the sound field the listener wishes to reproduce with respect to reverberation.

Creation of the time-series coefficient data for the front high channels by using a scheme as described above makes it possible to share the speaker characteristics SPr of the time-series coefficient data to be set for the digital filters 51-HL and 51-HR. This can reduce a difference between sound of the left channels and sound of the right channels, thus can significantly reduce the user's sense of discomfort in the sound-image localization. The left and right channels may share the data of the reverberation-part (indirect-sound part) data. In such a case, the amount of memory in the coefficient holding unit 104*a* can be reduced.

Figure 26:
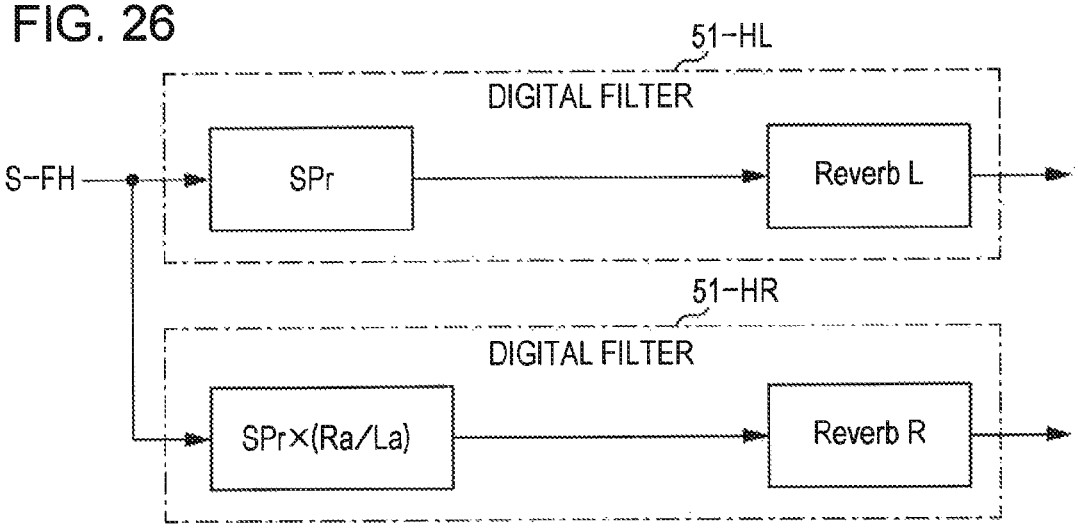
FIG. 26 is a modification of time-series coefficient data obtained by combination of actual-sound-field data and anechoic-room data.

The time-series coefficient data to be set for the digital filters 51-HL and 51-HR illustrated in FIG. 24 may also be transformed into data as illustrated in FIG. 26. In this case, the relative relationship between the transfer coefficient for the left channel and the transfer coefficient for the right channel is maintained.

An operation of the audio-signal processing device 100 illustrated in FIG. 1 will be briefly described next. The compressed audio stream Ast is input to the input terminal 102. The compressed audio stream Ast is supplied to the decoding unit 103. The decoding unit 103 performs decode processing in a mode corresponding to the format of the compressed audio stream Ast. In this case, the format information of the compressed audio stream Ast and the decode-mode information are sent to the control unit 101.

Audio signals for a predetermined number of channels (e.g., 2 channels, 6 channels, or 8 channels), the audio signals being obtained by the decoding unit 103, are supplied to the signal processing unit 105 through corresponding dedicated signal lines. Under the control of the control unit 101, the coefficient setting unit 104 sets filter coefficients corresponding to an estimated-channel layout for the digital filters in the signal processing unit 105, on the basis of the decode-mode information of the decoding unit 103. That is, filter coefficients corresponding to the estimated channel positions determined by the decode-mode information are set for the digital filters for the channels indicated by the decode-mode information.

The signal processing unit 105 generates left-channel audio signals SL and right-channel audio signals SR to he supplied to the headphone device 200, on the basis of predetermined-number-of-channels audio signals obtained by the decoding unit 103. In this case, digital filters convolve impulse responses for paths from the sound-source positions of the channels to the left ear of a listener with the corresponding predetermined-number-of-channels audio signals and the results of the convolutions for the channels are added to generate the left-channel audio signals SL. Similarly, digital filters convolve impulse responses for paths from the sound-source positions of the channels to the right ear of the listener with the corresponding predetermined-number-of-channels audio signals and the results of the convolutions for the channels are added to generate the right-channel audio signals SR.

The left-channel audio signals St generated by the signal processing unit 105 are output from the output terminal 106L. The right-channel audio signals SR generated by the signal processing unit 105 are output from the output terminal 106R. The audio signals St and SR are supplied to the headphone 200 and are reproduced.

Figure 27:
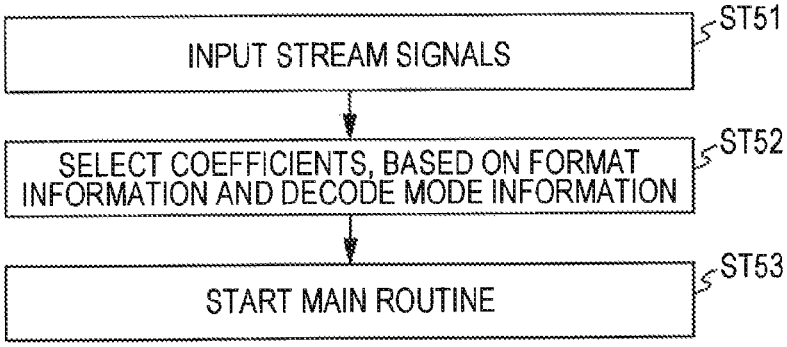
FIG. 27 is a flowchart illustrating an overview of a control procedure of a control unit in the audio-signal processing device.
Figure 28:
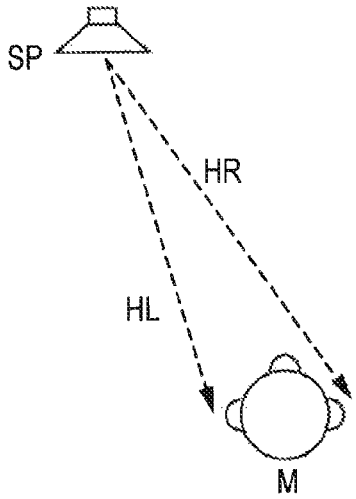
FIG. 28 illustrates sound-image localization of a headphone device.

FIG. 27 is a flowchart illustrating an overview of a control procedure of the control unit 101 in the audio-signal processing device 100 illustrated in FIG. 1. When the compressed audio stream Ast is input in step ST51, the process proceeds to step ST52 in which the control unit 101 selects filter coefficients to be set for the signal processing unit 105 on the basis of the format information of the compressed audio stream Ast and the decode-mode information of the decoding unit 103 and the coefficient setting unit 104 sets the selected filter coefficients. After step ST52, in step ST53, the control unit 101 starts the main routine for control.

As described above, the audio-signal processing device 100 illustrated in FIG. 1 sets filter coefficients corresponding to an estimated-channel layout for the digital filters in the signal processing unit 105, on the basis of the decode-mode information of the decoding unit 103. Thus, even when the format of the compressed audio stream Ast is changed, 2-channel stereo audio signals with which sound-image localization for each channel can be performed in a favorable manner can be obtained from audio signals for a predetermined number of channels.

In the audio-signal processing device 100 illustrated in FIG. 1, the digital filters, provided in the signal processing unit 105, for processing audio signals (subwoofer signals) for the low-frequency enhancement channel (LFE) are implemented by IIR filters. Thus, it is possible to reduce the amounts of memory and computation for processing the low-frequency enhancement channel (LFE) audio signals.

In the audio-signal processing device 100 illustrated in FIG. 1, the filter coefficients to be set for the digital filters, provided in the signal processing unit 105, for processing the front high channel audio signals are data obtained by combining actual-sound-field data and anechoic-room data. Thus, for example, even for only a general 5.1 channel layout in an actual sound field, the filter coefficients for the front high channels of 7.1 channels can be easily obtained.

In the audio-signal processing device 100 illustrated in FIG. 1, the coefficient holding unit 104*a* in the coefficient setting unit 104 holds the time-series coefficient data as the filter coefficients corresponding to the impulse responses. During coefficient setting, the FFT unit 104*b* transforms the time-series coefficient data into frequency-domain data, which are then set for the digital filters. Accordingly, it is possible to reduce the amount of memory in the coefficient holding unit 104*a* that holds the filter coefficients.

Thus, according to the present technology, even when the format of the compressed audio stream Ast is changed, 2-channel stereo audio signals with which sound-image localization for each channel can be performed in a favorable manner can be obtained from audio signals for a predetermined number of channels. According to the present technology, it is possible to reduce the amounts of memory and computation for processing audio signals for the bass-dedicated channels. In addition, according to the present technology, for example, even for only a general 5.1 channel layout in an actual sound field, the filter coefficients for the front high channels of 7.1 channels can be easily obtained. According to the present technology, it is possible to reduce the amount of memory that holds the filter coefficients.

<2. Modification>

A description in the embodiment described above has been given of an example in which 2-channel audio signals for driving the headphone device are generated from multi-channel audio signals. Needless to say, not only can the present technology be applied to the headphone device, but also the present technology can be applied to a case in which, for example, 2-channel audio signals for driving 2-channel speakers arranged adjacent to the listener are generated.

The present technology may be configured as described below.

(1) An audio-signal processing device including:

a decoding unit configured to decode a compressed audio stream to obtain audio signals for a predetermined number of channels;

a signal processing unit configured to generate 2-channel audio signals including left-channel audio signals and right-channel audio signals, on a basis of the predetermined-number-of-channels audio signals obtained by the decoding unit, wherein the signal processing unit uses digital filters to convolve impulse responses for paths from sound-source positions of the channels to a left ear of a listener with the corresponding predetermined-number-of-channels audio signals and adds results of the convolutions for the channels to generate the left-channel audio signals, and uses digital filters to convolve impulse responses for paths from the sound-source positions of the channels to a right ear of the listener with the corresponding predetermined-number-of-channels audio signals and adds results of the convolutions for the channels to generate the right-channel audio signals; and a coefficient setting unit configured to set filter coefficients corresponding to the impulse responses for the digital filters in the signal processing unit, on a basis of format information of the compressed audio stream.

(2) The audio-signal processing device according to (1), wherein, the coefficient setting unit sets, for the digital filters for the channels indicated by decode-mode information of the decoding unit, filter coefficients corresponding to an estimated channel layout determined by the format information.

(3) The audio-signal processing device according to (1) or (2), wherein at least one of the digital filters in the signal processing unit is used to process the audio signals for multiple ones of the predetermined number of channels.

(4) The audio-signal processing device according to (3), wherein the at least one digital filter used to process the audio signals for the multiple channels processes front high audio signals included in 7.1-channel audio signals or back surround audio signals included in 7.1-channel audio signals.

(5) An audio-signal processing method including:

decoding a compressed audio stream to obtain audio signals for a predetermined number of channels;

generating 2-channel audio signals including left audio signals and right, audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, and digital filters are used to convolve impulse responses for paths from the sound-source positions of the channels to a right ear of the listener with the corresponding predetermined-number-of-channels audio signals and results of the convolutions for the channels are added to generate the right audio signals; and setting filter coefficients corresponding to the impulse responses for the digital filters, on a basis of format information of the compressed audio stream.

(6) A program for causing a computer to execute an audio signal processing method including:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, and digital filters are used to convolve impulse responses for paths from the sound-source positions of the channels to a right ear of the listener with the corresponding predetermined-number-of-channels audio signals and results of the convolutions for the channels are added to generate the right audio signals; and setting filter coefficients corresponding to the impulse responses for the digital filters, on a basis of format information of the compressed audio stream.

(7) A recording medium storing a program for causing a computer to execute an audio signal processing method including:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, and digital filters are used to convolve impulse responses for paths from the sound-source positions of the channels to a right ear of the listener with the corresponding predetermined-number-of-channels audio signals and results of the convolutions for the channels are added to generate the right audio signals; and setting filter coefficients corresponding to the impulse responses for the digital filters, on a basis of format information of the compressed audio stream.

(8) An audio-signal processing device including:

a decoding unit configured to decode a compressed audio stream to obtain audio signals for a predetermined number of channels; and a signal processing unit configured to generate 2-channel audio signals including left audio signals and right audio signals, on a basis of the predetermined-number-of-channels audio signals obtained by the decoding unit;

wherein the signal processing unit uses digital filters to convolve impulse responses for paths from sound-source positions of the channels to a left ear of a listener with the corresponding predetermined-number-of-channels audio signals and adds results of the convolutions for the channels to generate the left audio signals, and uses digital filters to convolve impulse responses for paths from the sound-source positions of the channels to a right ear of the listener with the corresponding predetermined-number-of-channels audio signals and adds results of the convolutions for the channels to generate the right audio signals, and wherein, in the signal processing unit, the digital filters for processing at least the audio signals for a low-frequency enhancement channel are implemented by infinite impulse response filters.

(9) An audio-signal processing method including:

decoding a compressed audio stream to obtain audio signals for a predetermined number of channels; and generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, digital filters are used to convolve impulse responses for paths from the sound-source positions of the channels to a right ear of the listener with the corresponding predetermined-number-of-channels audio signals and results of the convolutions for the channels are added to generate the right audio signals, and infinite impulse response filters are used as the digital filters to process at least the audio signals for a low-frequency enhancement channel.

(10) A program for causing a computer to execute an audio signal processing method including:

decoding a compressed audio stream to obtain audio signals for a predetermined number of channels; and generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, digital filters are used to convolve impulse responses for paths from the sound-source positions of the channels to a right ear of the listener with the corresponding predetermined-number-of-channels audio signals and results of the convolutions for the channels are added to generate the right audio signals, and infinite impulse response filters are used as the digital filters to process at least the audio signals for a low-frequency enhancement channel.

(11) A recording medium storing a program for causing a computer to execute an audio signal processing method including:

decoding a compressed audio stream to obtain audio signals for a predetermined number of channels; and generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, digital filters are used to convolve impulse responses for paths from the sound-source positions of the channels to a right ear of the listener with the corresponding predetermined-number-of-channels audio signals and results of the convolutions for the channels are added to generate the right audio signals, and infinite impulse response filters are used as the digital filters to process at least the audio signals for a low-frequency enhancement channel.

(12) An audio-signal processing device, including:

a decoding unit configured to decode a compressed audio stream to obtain audio signals for a predetermined number of channels; and a signal processing unit configured to generate 2-channel audio signals including left audio signals and right audio signals, on a basis of the predetermined-number-of-channels audio signals obtained by the decoding unit;

wherein the signal processing unit uses digital filters to convolve impulse responses for paths from sound-source positions of the channels to a left ear of a listener with the corresponding predetermined-number-of-channels audio signals and adds results of the convolutions for the channels to generate the left audio signals, and uses digital filters to convolve impulse responses for paths from the sound-source positions of the channels to a right ear of the listener with the corresponding predetermined-number-of-channels audio signals and adds results of the convolutions for the channels to generate the right audio signals, and wherein, in the signal processing unit, the filter coefficient set for the digital filter for processing audio signals for a front high channel is data obtained by combination of actual-sound-field data and anechoic-room data.

(13) The audio-signal processing device according to (12), wherein the actual-sound-field data includes a speaker characteristic of a front channel and data of reverberation part of the front channel.

(14) An audio-signal processing method including:

decoding a compressed audio stream to obtain audio signals for a predetermined number of channels; and generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, digital filters are used to convolve impulse responses for paths from the sound-source positions of the channels to a right ear of the listener with the corresponding predetermined-number-of-channels audio signals and results of the convolutions for the channels are added to generate the right audio signals, and the filter coefficient set for the digital filter for processing the audio signals for a front high channel is data obtained by combination of actual-sound-field data and anechoic-room data.

(15) A program for causing a computer to execute an audio signal processing method including:

decoding a compressed audio stream to obtain audio signals for a predetermined number of channels; and generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, digital filters are used to convolve impulse responses for paths from the sound-source positions of the channels to a right ear of the listener with the corresponding predetermined-number-of-channels audio signals and results of the convolutions for the channels are added to generate the right audio signals, and the filter coefficient set for the digital filter for processing the audio signals for a front high channel is data obtained by combination of actual-sound-field data and anechoic-room data.

(16) A recording medium storing a program for causing a computer to execute an audio signal processing method including:

decoding a compressed audio stream to obtain audio signals for a predetermined number of channels; and generating 2-channel audio signals including left audio signals and right audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left audio signals, digital filters are used to convolve impulse responses for paths from the sound-source positions of the channels to a right ear of the listener with the corresponding predetermined-number-of-channels audio signals and results of the convolutions for the channels are added to generate the right audio signals, and the filter coefficient set for the digital filter for processing the audio signals for a front high channel is data obtained by combination of actual-sound-field data and anechoic-room data.

(17) An audio-signal processing device including:

a decoding unit configured to decode a compressed audio stream to obtain audio signals for a predetermined number of channels;

a signal processing unit configured to generate 2-channel audio signals including left-channel audio signals and right-channel audio signals, on a basis of the predetermined-number-of-channels audio signals obtained by the decoding unit, wherein the signal processing unit uses digital filters to convolve impulse responses for paths from sound-source positions of the channels to a left ear of a listener with the corresponding predetermined-number-of-channels audio signals and adds results of the convolutions for the channels to generate the left-channel audio signals and uses digital filters to convolve impulse responses for paths from the sound-source positions of the channels to a right ear of the listener with the corresponding predetermined-number-of-channels audio signals and adds results of the convolutions for the channels to generate the right-channel audio signals, and the convolutions by the digital filters are performed in a frequency domain;

a coefficient holding unit configured to hold time-series coefficient data as filter coefficients corresponding to the impulse responses; and a coefficient setting unit configured to read the time-series coefficient data held by the coefficient holding unit, transform the time-series coefficient data into frequency-domain data, and set the frequency-domain data for the digital filters.

(18) An audio-signal processing device including:

decoding a compressed audio stream to obtain audio signals for a predetermined number of channels;

generating 2-channel, audio signals including left-channel audio signals and right-channel audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left-channel audio signals, digital filters are used to convolve impulse responses for paths from the sound-source positions of the channels to a right ear of the listener with the corresponding predetermined-number-of-channels audio signals and results of the convolutions for the channels are added to generate the right-channel audio signals, and the convolutions by the digital filters are performed in a frequency domain; and reading time-series coefficient data held by a coefficient holding unit, transforming the time-series coefficient data into frequency-domain data, and setting the frequency-domain data for the digital filters.

(19) A program for causing a computer to execute an audio signal processing method including:

decoding a compressed audio stream to obtain audio signals for a predetermined number of channels;

generating 2-channel audio signals including left-channel audio signals and right-channel audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left-channel audio signals, digital filters are used to convolve impulse responses for paths from the sound-source positions of the channels to a right ear of the listener with the corresponding predetermined-number-of-channels audio signals and results of the convolutions for the channels are added to generate the right-channel audio signals, and the convolutions by the digital filters are performed in a frequency domain; and reading time-series coefficient data held by a coefficient holding unit, transforming the time-series coefficient data into frequency-domain data, and setting the frequency-domain data for the digital filters.

(20) A recording medium storing a program for causing a computer to execute an audio signal processing method including:

decoding a compressed audio stream to obtain audio signals for a predetermined number of channels;

generating 2-channel audio signals including left-channel audio signals and right-channel audio signals, on a basis of the predetermined-number-of-channels audio signals obtained in the decoding, wherein, in the generating, digital filters are used to convolve impulse responses for paths from sound-source positions of the channels to a left ear of a listener with the corresponding predetermined-number-of-channels audio signals and results of the convolutions for the channels are added to generate the left-channel audio signals, digital filters are used to convolve impulse responses for paths from the sound-source positions of the channels to a right ear of the listener with the corresponding predetermined-number-of-channels audio signals and results of the convolutions for the channels are added to generate the right-channel audio signals, and the convolutions by the digital filters are performed in a frequency domain; and reading time-series coefficient data held by a coefficient holding unit, transforming the time-series coefficient data into frequency-domain data, and setting the frequency-domain data for the digital filters.

The present disclosure contains subject matter related to that disclosed in Japanese Priority Patent Application JP 2011-223485 filed in the Japan Patent Office on Oct. 7, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An audio-signal processing device comprising:

a decoding unit configured to decode a compressed audio stream to obtain audio signals for a predetermined number of channels;

a signal processing unit configured to generate 2-channel audio signals including left-channel audio signals and right-channel audio signals, on a basis of the predetermined-number-of-channels audio signals obtained by the decoding unit, wherein the signal processing unit uses a first plurality of digital filters to convolve impulse responses for paths from sound-source positions of the channels to a left ear of a listener with the corresponding predetermined-number-of-channels audio signals and adds results of the convolutions for the channels to generate the left-channel audio signals, and uses a second plurality of digital filters to convolve impulse responses for paths from the sound-source positions of the channels to a right ear of the listener with the corresponding predetermined-number-of-channels audio signals and adds results of the convolutions for the channels to generate the right-channel audio signals; and a coefficient setting unit configured to set filter coefficients for the first plurality of digital filters and the second plurality of digital filters, selected from filter coefficients being held in a coefficient holding unit as time-series coefficient data corresponding to the impulse responses for the digital filters in the signal processing unit, on a basis of a received format information that indicates a format of the compressed audio stream and of a decode-mode information of the decoding unit, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, wherein the predetermined-number-of-channels audio signals are 7.1 channel audio signals including a front high signal or a back surround signal, wherein the coefficient setting unit is further configured to set filter coefficients for the front high signal or the back surround signal to be the selected filter coefficients shared by the two or more digital filters, and wherein the decoding unit, the signal processing unit, and the coefficient setting unit are each implemented via at least one processor.

2. The audio-signal processing device according to claim 1, wherein, the coefficient setting unit sets, for the digital filters for the channels indicated by decode-mode information of the decoding unit, filter coefficients corresponding to an estimated channel layout determined by the format information.

3. The audio-signal processing device according to claim 1, wherein the signal processing unit uses the first plurality of digital filters to convolve, in a frequency domain, the impulse responses for paths from the sound-source positions of the channels to the left ear of the listener with the corresponding predetermined-number-of-channels audio signals, and the signal processing unit uses the second plurality of digital filters to convolve, in the frequency domain, the impulse responses for paths from the sound-source positions of the channels to the right ear of the listener with the corresponding predetermined-number-of-channels audio signals.

4. The audio-signal processing device according to claim 3, wherein the coefficient setting unit sets, as frequency-domain data, the filter coefficients corresponding to the impulse responses for the digital filters in the signal processing unit.

5. The audio-signal processing device according to claim 4, wherein the coefficient setting unit sets the filter coefficients corresponding to the impulse responses for the digital filters in the signal processing unit, on a basis of the format information of the compressed audio stream and on decode-mode information of the decoding unit.

6. The audio-signal processing device according to claim 1, wherein the coefficient setting unit sets the filter coefficients corresponding to the impulse responses for the digital filters in the signal processing unit, on a basis of the format information of the compressed audio stream and on decode-mode information of the decoding unit.

7. The audio-signal processing device according to claim 1, wherein the format information is provided separately from audio signals of the compressed audio stream.

8. The audio-signal processing device according to claim 1, wherein the audio-signal processing device is configured for processing the compressed audio stream in accordance with a selected audio format chosen from a plurality of candidate audio formats, the audio-signal processing device being configured for processing according to the selected audio format in response to processing of the received format information.

9. The audio-signal processing device according to claim 1, wherein the at least one individual filter coefficient of the selected filter coefficients is shared by the two or more digital filters in accordance with sound-source positions of the two or more channels corresponding to the two or more digital filters.

10. The audio-signal processing device according to claim 1, wherein the at least one individual filter coefficient of the selected filter coefficients is shared by two or more digital filters of either the first plurality of digital filters or the second plurality of filters.

11. The audio-signal processing device according to claim 1, wherein the at least one individual filter coefficient of the selected filter coefficients is shared by at least one digital filter of the first plurality of filters and at least one digital filter of the second plurality of filters.

12. The audio-signal processing device according to claim 1, wherein the at least one shared individual filter coefficient represents reverberation data for channels used by the two or more sharing digital filters, and further wherein the two or more sharing digital filters each use independent filter coefficients for direct-sound data corresponding to each one of such channels.

13. An audio-signal processing method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, and a second plurality of digital filters are used to convolve impulse responses for paths from the sound-source positions of the channels to a right ear of the listener with the corresponding predetermined-number-of-channels audio signals and results of the convolutions for the channels are added to generate the right audio signals;

setting filter coefficients, selected from filter coefficients being held in a coefficient holding unit as time-series coefficient data corresponding to the impulse responses for the digital filters, on a basis of a received format information that indicates a format of the compressed audio stream and of a decode-mode information of the decoding unit, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

14. A non-transitory computer-readable medium having embodied thereon a program, which when executed by a computer causes the computer to execute an audio signal processing method, the method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, and a second plurality of digital filters are used to convolve impulse responses for paths from the sound-source positions of the channels to a right ear of the listener with the corresponding predetermined-number-of-channels audio signals and results of the convolutions for the channels are added to generate the right audio signals;

setting filter coefficients, selected from filter coefficients being held in a coefficient holding unit as time-series coefficient data corresponding to the impulse responses for the digital filters, on a basis of a received format information that indicates a format of the compressed audio stream and of a decode-mode information of the decoding unit, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

15. A non-transitory computer-readable recording medium storing a program executable by a computer for controlling the computer to execute an audio signal processing method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, and a second plurality of digital filters are used to convolve impulse responses for paths from the sound-source positions of the channels to a right ear of the listener with the corresponding predetermined-number-of-channels audio signals and results of the convolutions for the channels are added to generate the right audio signals;

setting filter coefficients, selected from filter coefficients being held in a coefficient holding unit as time-series coefficient data corresponding to the impulse responses for the digital filters, on a basis of a received format information that indicates a format of the compressed audio stream and of a decode-mode information of the decoding unit, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

16. An audio-signal processing device, comprising:

a decoding unit configured to decode a compressed audio stream to obtain audio signals for a predetermined number of channels; and a signal processing unit configured to generate 2-channel audio signals including left audio signals and right audio signals, on a basis of the predetermined-number-of-channels audio signals obtained by the decoding unit;

wherein the signal processing unit uses a first plurality of digital filters to convolve impulse responses for paths from sound-source positions of the channels to a left ear of a listener with the corresponding predetermined-number-of-channels audio signals and adds results of the convolutions for the channels to generate the left audio signals, and uses a second plurality of digital filters to convolve impulse responses for paths from the sound-source positions of the channels to a right ear of the listener with the corresponding predetermined-number-of-channels audio signals and adds results of the convolutions for the channels to generate the right audio signals, wherein, in the signal processing unit, the digital filters for processing at least the audio signals for a low-frequency enhancement channel are implemented by infinite impulse response filters having filter coefficients selected from filter coefficients being held in a coefficient holding unit as time-series coefficient data corresponding to the impulse responses for the digital filters in the signal processing unit, the filter coefficients being set based a received format information that indicates a format of the compressed audio stream and also based on a decode-mode information of the decoding unit, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and a coefficient setting unit configured to set filter coefficients for the front high signal or the back surround signal to be the selected filter coefficients shared by the two or more digital filters, wherein the decoding unit, the signal processing unit, and the coefficient setting unit are each implemented via at least one processor.

17. An audio-signal processing method comprising:

decoding a compressed audio stream to obtain audio signals for a predetermined number of channels; and generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right audio signals, and infinite impulse response filters are used as the digital filters to process at least the audio signals for a low-frequency enhancement channel, wherein the infinite impulse response filters have filter coefficients selected from filter coefficients being held in a coefficient holding unit as time-series coefficient data corresponding to the impulse responses for the digital filters, the filter coefficients being set based a received format information that indicates a format of the compressed audio stream and also based on a decode-mode information, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

18. A non-transitory computer-readable medium having embodied thereon a program, which when executed by a computer causes the computer to execute an audio signal processing method, the method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right audio signals, and infinite impulse response filters are used as the digital filters to process at least the audio signals for a low-frequency enhancement channel, wherein the infinite impulse response filters have filter coefficients selected from filter coefficients being held in a coefficient holding unit as time-series coefficient data corresponding to the impulse responses for the digital filters, the filter coefficients being set based a received format information that indicates a format of the compressed audio stream and also based on a decode-mode information, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal;

setting filter coefficients for the front high signal or the back surround signal to be the selected filter coefficients shared by the two or more digital filters.

19. A non-transitory computer-readable recording medium storing a program executable by a computer for controlling the computer to execute an audio signal processing method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right audio signals, and infinite impulse response filters are used as the digital filters to process at least the audio signals for a low-frequency enhancement channel, wherein the infinite impulse response filters have filter coefficients selected from filter coefficients being held in a coefficient holding unit as time-series coefficient data corresponding to the impulse responses for the digital filters, the filter coefficients being set based a received format information that indicates a format of the compressed audio stream and also based on a decode-mode information, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal, setting filter coefficients for the front high signal or the back surround signal to be the selected filter coefficients shared by the two or more digital filters.

20. An audio-signal processing device, comprising:

a decoding unit configured to decode a compressed audio stream to obtain audio signals for a predetermined number of channels;

a signal processing unit configured to generate 2-channel audio signals including left audio signals and right audio signals, on a basis of the predetermined-number-of-channels audio signals obtained by the decoding unit, wherein the signal processing unit uses a first plurality of digital filters to convolve impulse responses for paths from sound-source positions of the channels to a left ear of a listener with the corresponding predetermined-number-of-channels audio signals and adds results of the convolutions for the channels to generate the left audio signals, and uses a second plurality of digital filters to convolve impulse responses for paths from the sound-source positions of the channels to a right ear of the listener with the corresponding predetermined-number-of-channels audio signals and adds results of the convolutions for the channels to generate the right audio signals, wherein, in the signal processing unit, a filter coefficient set for the digital filter for processing audio signals for a particular channel is data obtained by combination of actual-sound-field data and anechoic-room data, and the filter coefficient is selected from filter coefficients being held in a coefficient holding unit as time-series coefficient data corresponding to the impulse responses for the digital filters, the filter coefficient being set based on a received format information that indicates a format of the compressed audio stream and also based on a decode-mode information of the decoding unit, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and a coefficient setting unit is further configured to set filter coefficients for the front high signal or the back surround signal to be the selected filter coefficients shared by the two or more digital filters, wherein the decoding unit, the signal processing unit, and the coefficient setting unit are each implemented via at least one processor.

21. The audio-signal processing device according to claim 20, wherein the actual-sound-field data includes a speaker characteristic of a front channel and data of reverberation part of the front channel.

22. An audio-signal processing method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right audio signals, and a filter coefficient set for the digital filter for processing the audio signals for a particular channel is data obtained by combination of actual-sound-field data and anechoic-room data, wherein the filter coefficient is selected from filter coefficients being held in a coefficient holding unit as time-series coefficient data corresponding to the impulse responses for the digital filters, the filter coefficient being set based a received format information that indicates a format of the compressed audio stream and also based on a decode-mode information, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

23. A non-transitory computer-readable medium having embodied thereon a program, which when executed by a computer causes the computer to execute an audio signal processing method, the method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right audio signals, and a filter coefficient set for the digital filter for processing the audio signals for a particular channel is data obtained by combination of actual-sound-field data and anechoic-room data, wherein the filter coefficient is selected from filter coefficients being held in a coefficient holding unit as time-series coefficient data corresponding to the impulse responses for the digital filters, the filter coefficient being set based a received format information that indicates a format of the compressed audio stream and also based on a decode-mode information, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

24. A non-transitory computer-readable recording medium storing a program executable by a computer for controlling the computer to execute an audio signal processing method comprising:

decoding a compressed audio stream to obtain audio signals for a predetermined number of channels;

generating 2-channel audio signals including left audio signals and right audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right audio signals, and a filter coefficient set for the digital filter for processing the audio signals for a particular channel is data obtained by combination of actual-sound-field data and anechoic-room data, wherein the filter coefficient is selected from filter coefficients being held in a coefficient holding unit as time-series coefficient data corresponding to the impulse responses for the digital filters, the filter coefficient being set based a received format information that indicates a format of the compressed audio stream and also based on a decode-mode information, wherein the format information indicates a number of channels that are in the compressed audio stream, wherein at least one individual filter coefficient of the selected filter coefficients is shared by two or more digital filters selected from a group consisting of the first plurality of digital filters and the second plurality of digital filters, wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

25. An audio-signal processing device comprising:

a decoding unit configured to decode a compressed audio stream to obtain audio signals for a predetermined number of channels;

a signal processing unit configured to generate 2-channel audio signals including left-channel audio signals and right-channel audio signals, on a basis of the predetermined-number-of-channels audio signals obtained by the decoding unit, wherein the signal processing unit uses a first plurality of digital filters to convolve impulse responses for paths from sound-source positions of the channels to a left ear of a listener with the corresponding predetermined-number-of-channels audio signals and adds results of the convolutions for the channels to generate the left-channel audio signals, and uses a second plurality of digital filters to convolve impulse responses for paths from the sound-source positions of the channels to a right ear of the listener with the corresponding predetermined-number-of-channels audio signals and adds results of the convolutions for the channels to generate the right-channel audio signals, and wherein the convolutions by the digital filters are performed in a frequency domain;

a coefficient holding unit configured to hold time-series coefficient data as filter coefficients corresponding to the impulse responses; and a coefficient setting unit configured to read the time-series coefficient data held by the coefficient holding unit, transform the time-series coefficient data into frequency-domain data, and set the frequency-domain data for the digital filters, wherein filter coefficients are set for the digital filters based a received format information that indicates a format of the compressed audio stream and also based on a decode-mode information of the decoding unit, the format information indicating a number of channels that are in the compressed audio stream, wherein at least one individual filter coefficient of the set filter coefficients is shared by two or more digital filters selected from a group consisting of the first plurality of digital filters and the second plurality of digital filters, wherein the predetermined-number-of-channels audio signals are 7.1 channel audio signals including a front high signal or a back surround signal, wherein the coefficient setting unit is further configured to set filter coefficients for the front high signal or the back surround signal to be the selected filter coefficients shared by the two or more digital filters, and wherein the decoding unit, the signal processing unit, the coefficient holding unit, and the coefficient setting unit are each implemented via at least one processor.

26. An audio-signal processing method comprising:

decoding a compressed audio stream to obtain audio signals for a predetermined number of channels;

generating 2-channel audio signals including left-channel, audio signals and right-channel audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left-channel audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right-channel audio signals, and the convolutions by the digital filters are performed in a frequency domain;

reading time-series coefficient data held by a coefficient holding unit, transforming the time-series coefficient data into frequency-domain data, and setting the frequency-domain data for the digital filters, wherein filter coefficients are set for the digital filters based a received format information that indicates a format of the compressed audio stream and also based on a decode-mode information of the decoding unit, the format information indicating a number of channels that are in the compressed audio stream, wherein at least one individual filter coefficient of the set filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

27. A non-transitory computer-readable medium having embodied thereon a program, which when executed by a computer causes the computer to execute an audio signal processing method, the method comprising:

decoding a compressed audio stream to obtain audio signals for a predetermined number of channels;

generating 2-channel audio signals including left-channel audio signals and right-channel audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left-channel audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right-channel audio signals, and the convolutions by the digital filters are performed in a frequency domain;

reading time-series coefficient data held by a coefficient holding unit, transforming the time-series coefficient data into frequency-domain data and setting the frequency-domain data for the digital filters, wherein filter coefficients are set for the digital filters based a received format information that indicates a format of the compressed audio stream and also based on a decode-mode information of the decoding unit, the format information indicating a number of channels that are in the compressed audio stream, wherein at least one individual filter coefficient of the set filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

28. A non-transitory computer-readable recording medium storing a program executable by a computer for controlling the computer to execute an audio signal processing method comprising:

decoding a compressed audio stream to obtain audio signals for a predetermined number of channels;

generating 2-channel audio signals including left-channel audio signals and right-channel audio signals, on a basis of the predetermined-number-of-channels audio signals obtained in the decoding, wherein, in the generating, a first plurality of digital filters are used to convolve impulse responses for paths from sound-source positions of the channels to a left ear of a listener with the corresponding predetermined-number-of-channels audio signals and results of the convolutions for the channels are added to generate the left-channel audio signals, a second plurality of digital filters are used to convolve impulse responses for paths from the sound-source positions of the channels to a right ear of the listener with the corresponding predetermined-number-of-channels audio signals and results of the convolutions for the channels are added to generate the right-channel audio signals, and the convolutions by the digital filters are performed in a frequency domain;

reading time-series coefficient data held by a coefficient holding unit, transforming the time-series coefficient data into frequency-domain data, and setting the frequency-domain data for the digital filters, wherein filter coefficients are set for the digital filters based a received format information that indicates a format of the compressed audio stream and also based on a decode-mode information of the decoding unit, the format information indicating a number of channels that are in the compressed audio stream, wherein at least one individual filter coefficient of the set filter coefficients is shared by two or more digital filters selected from a group consisting of the first plurality of digital filters and the second plurality of digital filters, and wherein the predetermined-number-of-channels audio signals are 7.1 channel audio signals including a front high signal or a back surround signal; and setting filter coefficients for the front high signal or the back surround signal to be the selected filter coefficients shared by the two or more digital filters.

* * * * *